US008020725B2

(12) United States Patent
Yuyama et al.

(10) Patent No.: US 8,020,725 B2
(45) Date of Patent: Sep. 20, 2011

(54) MEDICINE DISPENSING APPARATUS

(75) Inventors: Shoji Yuyama, Toyonaka (JP); Masahiko Kasuya, Toyonaka (JP); Akitomi Kohama, Toyonaka (JP); Masatoshi Warashina, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 671 days.

(21) Appl. No.: 10/572,279

(22) PCT Filed: Sep. 17, 2004

(86) PCT No.: PCT/JP2004/013650

§ 371 (c)(1),
(2), (4) Date: Mar. 16, 2006

(87) PCT Pub. No.: WO2005/030113

PCT Pub. Date: Apr. 7, 2005

(65) Prior Publication Data

US 2007/0016327 A1 Jan. 18, 2007

(30) Foreign Application Priority Data

Sep. 26, 2003 (JP) ..... 2003-335647
Mar. 16, 2004 (JP) ..... 2004-074676

(51) Int. Cl.
*B65H 3/28* (2006.01)
*G07F 11/24* (2006.01)
*G07F 11/16* (2006.01)

(52) U.S. Cl. ..... 221/222; 221/2; 221/7; 221/76; 221/12; 221/130; 221/131; 221/155; 221/256; 221/6; 221/77; 221/97; 221/263; 221/221; 221/297; 221/312 C

(58) Field of Classification Search ..... 221/2, 7, 221/12, 76, 130, 131, 155, 253, 256, 6, 77, 221/97, 263, 222, 221, 277, 297, 312 C
See application file for complete search history.

(56) References Cited

U.S. PATENT DOCUMENTS 5,431,299 A 7/1995 Brewer et al.

(Continued)

FOREIGN PATENT DOCUMENTS

EP 1 118 318 7/2001

(Continued)

OTHER PUBLICATIONS

Supplementary European Search Report (in English language) issued Oct. 3, 2007 in European Appln. No. 04 77 3282.

(Continued)

*Primary Examiner* — Gene O. Crawford
*Assistant Examiner* — Rakesh Kumar
(74) *Attorney, Agent, or Firm* — Wenderoth, Lind & Ponack, L.L.P.

(57) ABSTRACT

A medicine dispensing apparatus which allows a prescribed quantity of medicines to be reliably taken out based on prescription data. The medicine dispensing apparatus includes a plurality of cassettes (3) which contain medicines in alignment, a pressing device (24) for pressing medicines in the cassette (3) toward one end side, a dispensing device (23) disposed at one end portion of the cassette and having a holding recess portion (26) for holding a medicine, a driving mechanism (51) for rotating the dispensing device (23) to a receiving position at which the medicine in the cassette (3) can be received in the holding recess portion (26) and to a taking out position at which the medicine held in the holding recess portion (26) can be taken out, a display (19) for displaying a cassette (3) containing medicines required to be dispensed among the cassettes, a driving switch (15) for rotating the dispensing device (23), and a controller (100) for rotating the dispensing device (23) from the receiving position to the taking out position by the driving mechanism (51) when the driving switch (15) of the cassette (3) displayed by the display is turned on.

9 Claims, 28 Drawing Sheets

U.S. PATENT DOCUMENTS

| | | | | |
|---|---|---|---|---|
| 5,460,294 | A * | 10/1995 | Williams | 221/2 |
| 6,119,892 | A * | 9/2000 | Laurent et al. | 221/2 |
| 7,006,893 | B2 * | 2/2006 | Hart et al. | 700/235 |
| 7,316,328 | B2 * | 1/2008 | Yuyama et al. | 221/227 |
| 2002/0070226 | A1 | 6/2002 | Liff et al. | |
| 2003/0075553 | A1 | 4/2003 | Amatsu et al. | |
| 2003/0089085 | A1 | 5/2003 | Shigeyama et al. | |
| 2003/0105554 | A1 | 6/2003 | Eggenberger et al. | |
| 2004/0251266 | A1 * | 12/2004 | Yuyama | 221/251 |

FOREIGN PATENT DOCUMENTS

| | | |
|---|---|---|
| EP | 1 241 617 | 9/2002 |
| EP | 1 435 334 | 7/2004 |
| JP | 5-229660 | 9/1993 |
| JP | 10-501143 | 2/1998 |
| JP | 10-201825 | 8/1998 |
| JP | 2000-072204 | 3/2000 |
| JP | 2001-163445 | 6/2001 |
| JP | 2001-198194 | 7/2001 |
| JP | 2002-011072 | 1/2002 |
| WO | 95/20804 | 8/1995 |
| WO | 97/08667 | 3/1997 |
| WO | 00/34925 | 6/2000 |
| WO | 01/21131 | 3/2001 |
| WO | 2003/022719 | 3/2003 |

OTHER PUBLICATIONS

European Office Action (in English language) issued May 3, 2008.
Chinese Office Action (in English language) issued Jul. 27, 2007.
European Search Report (in English language) issued Feb. 19, 2010 in corresponding to European Patent Appln. No. 10 15 0256.
European Official Communication issued Feb. 9, 2011 in corresponding European Patent Appln. No. 10 150 256.5.

* cited by examiner

Medicine master

| Medicion code | Medicine name | Unit 1 (medicine count) | Unit 2 (ml,mg) | Unit 3 (reserve) | Chime | Voice |
|---|---|---|---|---|---|---|

Medicine location master

| Department | Medicine code | Location information | Constant | Inventory (medicine count) | Number of cassettes |
|---|---|---|---|---|---|

Cassette master

| Department | Medicine code | cassette No. | Inventory |
|---|---|---|---|

MEDICINE DISPENSING APPARATUS

BACKGROUND OF THE INVENTION

1. Technical Field

The present invention relates to a medicine dispensing apparatus capable of dispensing medicines one by one.

2. Description of the Related Art

Conventionally, medicines are contained in cassettes fixed to a stock shelf in such a way that the cassettes can be pulled out. According to need, a cassette is pulled out from the storage shelf so that a medicine contained in the cassette can be extracted (see, e.g., JP H10-201825 A).

However, in the stock shelf, the medicine should be grasped from an upper aperture of the pulled-out cassette, and therefore the contained medicine is sometimes difficult to extract depending on the arranged position of the cassette. Moreover, as the number of medicines contained in the cassette increases, not only the cassette itself is difficult to pull out but also the medicines contained on the inner side of the cassette are hard to extract. Further, in the case of, for example, a medicine such as anticancer drugs whose administration is strictly restricted; it is not desirable to allow free access to the medicine. However, adopting a structure featuring a solution such as locking will deteriorate workability and also require an additional operation to confirm that the medicines are securely locked up.

SUMMARY OF THE INVENTION

It is a primary object of the present invention to provide a medicine dispensing apparatus which allows a prescribed quantity of medicines to be reliably taken out based on prescription data. It is another object of the present invention to provide a medicine dispensing apparatus which allows medicines to be reliably taken out without leaving the medicines uncollected. It is still another object of the present invention to provide a medicine dispensing apparatus which allows only those who are authorized to reliably take out medicines.

According to a first aspect of the present invention, there is provided a medicine dispensing apparatus, comprising:

a plurality of cassettes which contain medicines in alignment;

pressing means for pressing medicines in the cassette toward one end side;

dispensing means disposed at one end portion of the cassette and having a holding recess portion for holding a medicine;

driving means for rotating the dispensing means to a receiving position at which the medicine in the cassette can be received in the holding recess portion and to a taking out position at which the medicine held in the holding recess portion can be taken out;

display means for displaying a cassette containing medicines required to be dispensed among the cassettes;

a driving switch for rotating the dispensing means; and control means for rotating the dispensing means from the receiving position to the taking out position by the driving means when the driving switch of the cassette displayed by the display means is turned on.

Herein, the "medicines in alignment" refer to the medicines aligned in one direction in any orientation including vertical, horizontal and upright orientations, and includes the medicines that are stacked up like rice bales in an upper direction.

"A plurality of cassettes" refer to cassettes with shapes and sizes that are not necessarily identical but possibly different.

The "pressing means" includes those using a driving mechanism such as springs, motors and belts, and a weight which rotates or slides along an inclined face due to its own weight, as well as those using the weight of the medicines themselves so that the medicines can be received in the holding recess portion of the dispensing means. Moreover, the "pressing means" is not limited to those pressing the rear medicine of the aligned medicines but includes those pressing the middle medicine or the medicine before the dispensing means.

"One end portion" of the cassette at which the "dispensing means" is disposed includes the outer end and the inside of the cassette.

The "holding recess portion" of the dispensing means has only to hold one medicine and to have a shape and size that will allow extraction of the medicine, and includes those formed into a net or a basket shape and those formed into a U-shape or a V-shape. Moreover, the holding recess portion does not have to hold the entire medicine but has to hold a part or say about a half of the medicine. Basically, the holding recess portion is required to hold the medicine while the dispensing means rotates from the receiving position to the taking out position.

The "receiving position" of the dispensing means refers to a position at which the holding recess portion can receive one top medicine among the aligned medicines when the holding recess portion is rotated from the taking out position in the empty state.

The "driving member" includes those rotating the dispensing means around its shaft or swiveling the dispensing means in a vertical direction, and those driving the dispensing means in a combination of these movements.

The "display means", which has only to display the location of the cassette containing the medicine which needs to be dispensed based on a prescription order, includes optical displays using light-emitting means such as LEDs, and visual displays using characters, colors and color changes. Moreover, the "display means" may be disposed in the vicinity of each cassette, disposed on the cassette itself, or disposed away from the cassette if the display means can be associated with the location of each cassette and allows operators to easily recognize the location.

The "driving switch" includes switches of contact-type, noncontact-type and light transmission-type, and reed relays. Moreover, the position of the "driving switch" may be disposed in the vicinity of each cassette, disposed on the cassette itself, or disposed away from the cassette if the driving switch can be associated with the position of each cassette and allows operators to easily recognize the position.

The "control means" includes all control devices including microcomputers and personal computers (PCs). Moreover, the "control means" may be a plurality of units for distributed processing.

According to a second aspect of the invention, the control means controls the driving means so that the dispensing means is rotated from the receiving position to the taking out position by the driving means, and then if the driving switch is turned on, the dispensing means is rotated from the taking out position to the receiving position and then is rotated from the receiving position to the taking out position by the driving means.

According to a third aspect of the invention, there is further provided an end button that is pressed when a necessary number of medicines are taken out, and when the end button is operated, the control means turns off the display by the display means and controls the driving means to rotate the dispensing means from the taking out position to the receiving position.

The "end button" herein includes mechanical switches and touch panels.

According to a fourth aspect of the invention, there are further provided storage means for storing a quantity of inventory of medicines in the cassette, detection means for detecting a current quantity of medicines in the cassette, and notification means for notifying that the medicine is left uncollected. The control means controls the notification means to notify that the medicine is left uncollected when the current quantity of the medicines detected by the detection means is equal to the quantity of inventory stored in the storage means.

The "storage means" herein includes those tentatively storing data in the control device. The format of the "storage means" naturally includes smart medias, hard disks, CDs, RAMs and ROMs.

The "detection means" includes those employing various detection methods such as image recognition, weighing and light transmission.

As the "notification means", liquid display panels, LEDs, lamps and buzzers may be used.

According to a fifth aspect of the present invention, when the current quantity of medicines detected by the detection means is smaller than the quantity of inventory stored in the storage means, the control means stores the current quantity of the medicines detected by the detection means in the storage means as a quantity of inventory.

According to a sixth aspect of the present invention, authentication means is provided for authenticating an operator of the medicine dispensing apparatus. The control means executes the control operation only when the operator authenticated by the authentication means is an authorized operator.

The "authentication means" herein includes authentication systems with various methods using user IDs, passwords, fingerprints, irises, facial recognition and the like.

In another aspect of the invention, there are provided a plurality of devices for dispensing medicine connected to a network and including a storage means for storing various master files, wherein when any one of the master files of the medicine dispensers is updated, the master files of the remaining devices for dispensing medicine are all updated.

With this structure, even if the network is disconnected, each medicine dispensing apparatus can make reference to data in various master files stored in the storage means so as to execute dispensation processing of medicines.

As the master file stored in the storage means, there are, for example, a medicine master in which data on medicines including medicine codes and medicine names is stored, a medicine location master in which data on location of medicines including departments, medicine codes and location information is stored, and a cassette master in which data on each cassette including departments, medicine codes and cassette Nos. is stored.

Among the devices for dispensing medicine, one which receives inputs of prescription data is set to be a parent unit and the remaining devices are set to be child units. The parent unit may create dispensation data by making reference to the medicine location master and the cassette master based on the prescription data, while a child unit, if it is the unit to dispense the medicine in conformity with the dispensation data, may execute dispensation processing of the medicine.

Moreover, as another aspect of the present invention, there is provided a medicine dispensing apparatus preferably including a plurality of cassettes which store medicines in alignment, and a control means for exercising dispensation control by returning a request permission signal upon reception of a dispensation permission request signal from any one of the cassettes.

More specifically, the control means preferably includes a cassette controller provided for every desired quantity of cassettes, a main controller for managing a plurality of the cassette controllers, and a control device for creating dispensation data from description data, sending the data to each cassette controller via the main controller, and returning a dispensation permission signal upon reception of a dispensation permission request signal from any one of the cassette controllers via the main controller.

With this structure, the medicines can be dispensed only when a dispensation request signal from the cassette side is received and a request permission signal is returned, and this allows proper control over, for example, dispensation from a plurality of cassettes containing identical medicines (parent-child cassettes). More particularly, dispensation of the medicines is permitted only when a permission request signal is sent from each of the parent-child cassettes and a request permission signal is returned, and this prevents excessive medicines from being dispensed accidentally, and therefore makes it possible to realize accurate dispensation processing.

Moreover, as another aspect of the invention, there is provided a medicine dispenser preferably including a plurality of cassettes which contain medicines in alignment, a cassette controller for controlling some cassettes out of the cassettes, and a control device in which each array element in a substrate composition array, which enumerates array elements each representing the number of cassettes controlled by each cassette controller, is expanded per cassette at power-on, and data read from each of corresponding cassettes is stored in each of the expanded cassettes to create a shelf composition array.

With this structure, the state of cassettes can be constantly detected at power-on, so that even if replacement of cassettes, supply of medicines to the cassettes or the like are performed during power-off, it becomes possible to get correct information and execute appropriate dispensation processing of the medicines.

The prescription data inputted into the parent unit is desirable in the point that when the prescription data is inputted from the server connected to the network, the parent unit can automatically create dispensation data based on the inputted prescription data.

In the parent unit, a host folder for storing dispensation data created based on the prescription data, and a send holder and a receive holder for storing data indicating that data to be stored in one of various master files has been updated may be constructed in the storage means, while in the child unit, a send folder for storing updated data which indicates data stored in one of the master files of the child unit has been updated and which is sent to the receive folder of the parent unit is constructed in the storage means. The child unit may read the dispensation data in the host folder in the parent unit, execute the medicine dispensation processing based on the dispensation data, and send updated data to the receive folder of the parent unit via the send folder so that the master file of the parent unit is updated since the master file is changed by the medicine dispensation processing.

Moreover, as another aspect of the present invention, there is provided a medicine dispensing apparatus including a plurality of cassettes which contain medicines in alignment, wherein among the cassettes, those containing identical medicines are regarded as parent-child cassettes, and if the number of medicines in parent-child cassettes is not more than the dispensation request number, dispensation from all the parent-child cassettes is permitted whereas if the number of medicines in parent-child cassettes exceeds the dispensation request number, the dispensation request is permitted only to the cassettes containing the medicines of the dispensation request number.

With this structure, when the dispensation request number of identical medicines is plural, not only medicines are dispensed from a plurality of locations by utilizing the parent-child cassettes, but also unnecessary discharge of medicines can be reliably prevented.

According to the first aspect of the present invention, when the driving switch of the cassette displayed by the display means is turned on, the dispensing means is rotated from the receiving position to the taking out position, and the medicine held in the holding recess portion of the dispensing means can be reliably taken out every time the driving switch is pressed.

According to the second aspect of the present invention, if the driving switch is further turned on after one medicine is taken out, then the dispensing means is rotated from the taking out position to the receiving position and then is rotated from the receiving position to the taking out position, so that a plurality of medicines can be reliably taken out.

According to the third embodiment, when the end button is pressed after a necessary quantity of medicine is taken out, the display by the display means is lost and the dispensing means is rotated from the taking out position to the receiving position, so that any more medicines cannot be taken out, so as to ensure that a necessary quantity of medicines can be reliably taken out.

According to the fourth and fifth aspect of the present invention, when the driving switch is pressed while there are medicines uncollected, it is determined that the current quantity is equal to the quantity of inventory, and so it is indicated in the display means that the medicine are collected, thereby allowing a necessary quantity of medicines to be reliably taken out without leaving them uncollected.

According to the sixth aspect of the invention, only the authenticated operator can take out the medicines, and this enables only the authorized operator to reliably take out the medicines.

BRIEF DESCRIPTION OF THE DRAWINGS

FIG. 2(*b*) is a plan view showing the holding member of FIG. 1;

REFERENCE NUMERALS

Figure 1:
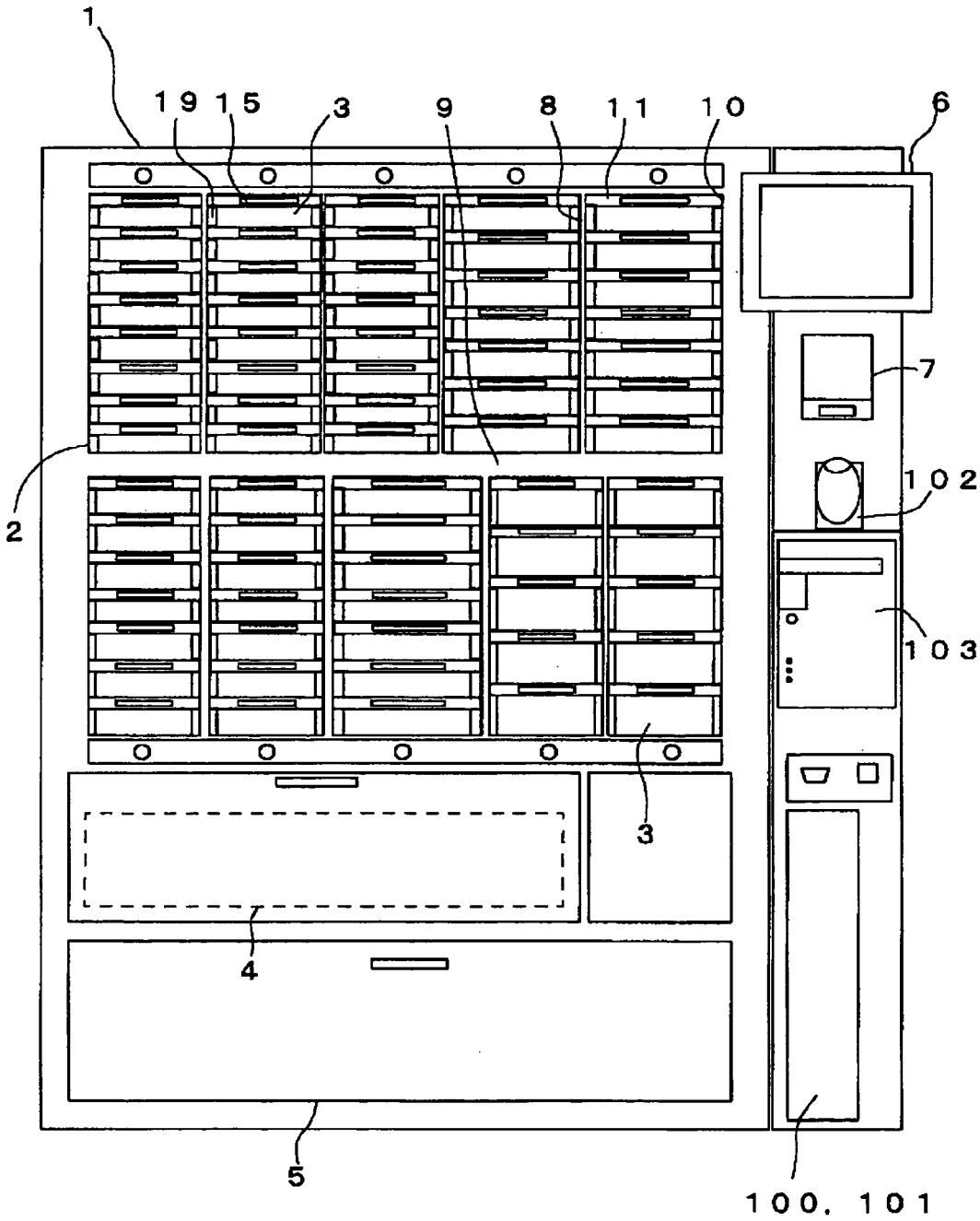
FIG. 1 is a schematic front view showing a medicine dispensing apparatus according to an embodiment of the present invention.

1: frame body
2: stock shelf
3: cassette
4: printer
5: storage portion
6: operation display panel
7: user authentication device
8: vertical plate
9: horizontal plate

10: support groove
11: housing member
12: shelf plate
13: side plate
14: reed switch
15: driving switch
16: protrusion
17: support portion
18: protruding portion
19: indicator
20: protruding portion
21: guide portion
22: cover article
23: rotor
24: pressing unit
25: engagement rack
25*a*: recess portion
26: holding recess portion
27: notch
28: shaft portion
28: shaft portion
28*a*: engagement recess portion
29: casing
30: constant force spring
30*a*: drum
30*b*: spring portion
31: engagement member
31*a*: operation portion
31*b*: gear portion
32: magnet
33: spindle
34: auxiliary gear
35: oil damper
36: guide
37: guide groove
38: locking mechanism
39: guide protrusion
40: circular disc
41: spring
42: lock frame
43: push-in portion
44: projection
45: groove portion
46: engagement groove
47: cover
48: slide groove
49*a*: recess portion
49*b*: recess portion
50: contact portion
51: driving mechanism
52: motor
53: worm gear
54: worm wheel
55: intermediate gear
55*a*: gear
55*b*: spur gear
56: driving gear
56*a*: driving shaft
56*b*: engagement protruding portion
100: control device
101: storage device
102: bar code reader
103: journal printer
104: open position sensor
105: home position sensor
106: unlock position sensor
200: host computer
201: parent unit
202: child unit
203: main controller
204: cassette controller
D: medicine

DETAILED DESCRIPTION OF THE INVENTION

Embodiments of the invention will now be described with reference to the accompanying drawings.

FIG. 1 shows a medicine dispensing apparatus according to the present embodiment. A frame body 1 of the medicine dispensing apparatus has a stock shelf 2, and in the stock shelf 2, a plurality of cassettes 3 are juxtaposed in a horizontal direction and are also tiered in a vertical direction. A printer 4 for discharging paper sheets on which prescription data including names of dispensed medicines, quantities thereof and the like are printed is provided below the stock shelf 2. Below the printer 4, a storage portion 5 for storing medicine boxes and the like is provided. On the front right-hand side face of the stock shelf 2, an operation display panel 6 is provided for allowing predetermined inputs and displays. Below the operation display panel 6, a user authentication device 7 is provided for authenticating whether the operator is authorized or not. On the front face of the stock shelf 2, a door or a shutter is provided. The stock shelf 2 is cooled so as to be at a specified temperature if required. It is to be noted that reference numeral 100 denotes a control device of the medicine dispensing apparatus including a storage device 101. Reference numeral 102 denotes a bar code reader for reading the bar code printed on the prescription sheet including the injection prescription sheet printed by the printer 4. Reference numeral 103 denotes a journal printer for printing prescription histories, dispensing results, dispensing time and the like.

The stock shelf 2 is composed of a plurality of vertical plates 8 and horizontal plates 9. Intervals between adjacent vertical plates 8 are set according to the size of the cassette 3 housed therebetween. A plurality of support grooves 10 are formed in the vertical direction on the side face of each vertical plate 8. Housing members 11 for housing the cassettes 3 are supported by the support grooves 10, which are opposed to each other. Intervals between the adjacent support grooves 10 in the vertical direction are set according to the size of the cassettes 3 housed therein.

Figure 2A:
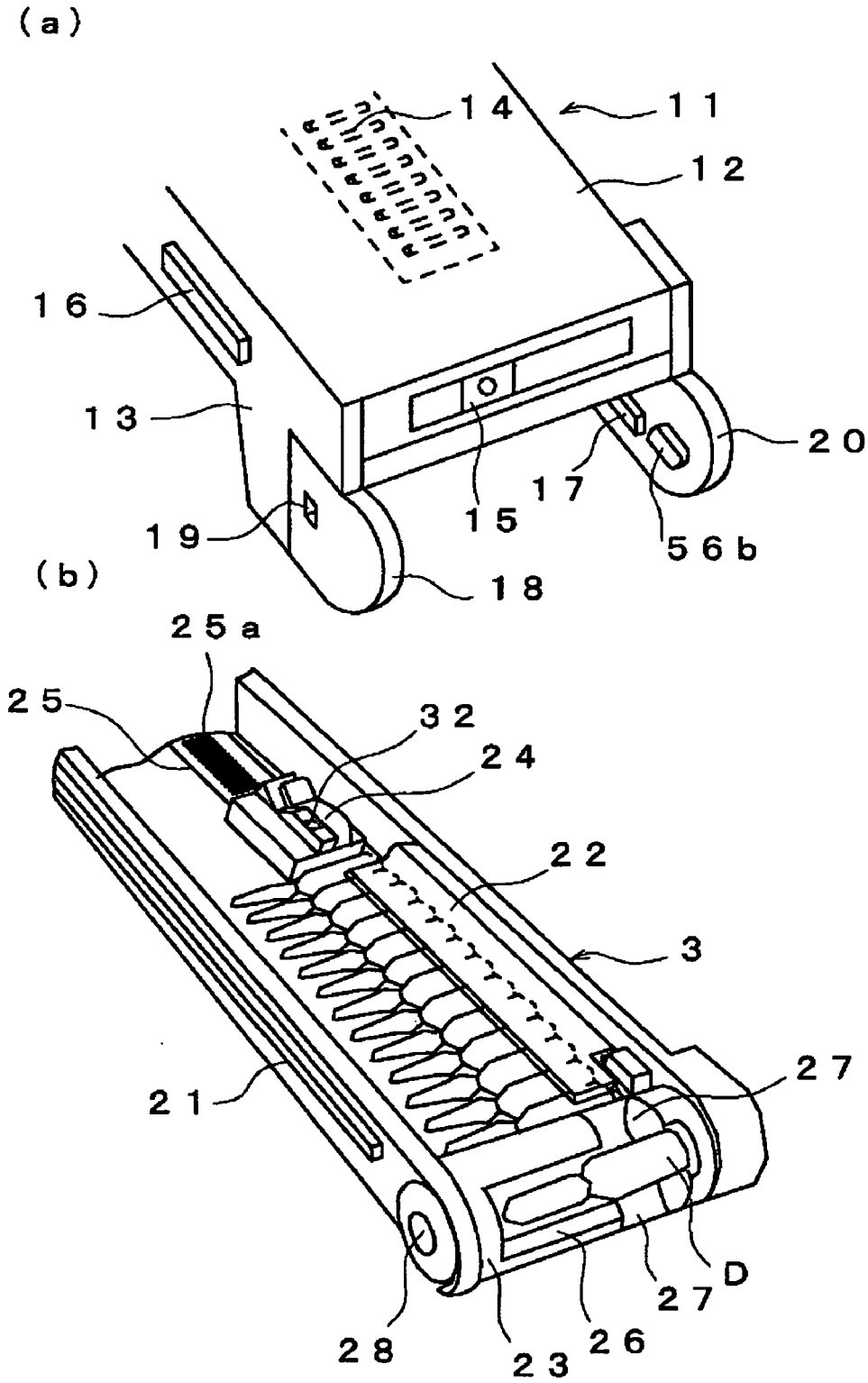
FIG. 2(*a*) is a fragmentary perspective view showing one example of a holding member of FIG. 1.

As shown in FIG. 2A, the housing member 11 is composed of a shelf plate 12, and side plates 13 extending downward from both side ends of the shelf plate 12. On the lower face of the shelf plate 12, a plurality of reed switches 14 are disposed at constant intervals as the detection means of the present invention for detecting the quantity of the medicines D in the cassette 3. On the end face of the shelf plate 12 on the front face side, a driving switch 15 corresponding to the cassette is provided. Only when the driving switch 15 is operated, a rotor 23 (described later) of the corresponding cassette 3 rotates, and the medicines D can be taken out. On the outer face of each side plate 13, a protrusion 16 which engages with a support groove 10 of the vertical plate 8 is formed, while a support portion 17 is formed on the inner face thereof. The support portion 17 slidably engages a later-described guide portion 21 of the cassette 3. On the front end of the left-hand side plate 13, a protruding portion 18 made of a semicircular translucent member is mounted. In the protruding portion 18, an indicator 19 made of a light-emitting diode (LED) is embedded as the display means of the present invention. Herein, two types of LED, a blue-color LED and an orange-color LED, are provided, and each of the LEDs can light or flash. Also on the front end of the right-hand side plate 13, a semicircular protruding portion 20 is provided. A driving mechanism 51 (see FIG. 10), for driving the rotor 23 of the cassette 3, is housed in the protruding portion 20.

As shown in FIG. 2A (see part b), the cassette 3 has a box shape that opens upward and forward. On its side face, a guide portion 21 is provided so as to engage with the support portion 17 of the housing members 11 and extend in a longitudinal direction. Moreover, a cover article 22 for covering the upward aperture portion is rotatably provided on the cassette 3. On the aperture end portion on the front side of the cassette 3, a rotor 23 that is the dispensing means of the present invention is provided for allowing medicines to be dispensed one by one. The medicines D in the cassette 3 are contained in an alignment, and are pressed toward the front side by a pressing unit 24 that is the pressing means of the present invention. On the inner bottom face of the cassette 3, an engagement rack 25 is formed in longitudinal direction of the cassette. The engagement rack 25 is composed of a plurality of horizontally-enlongated recess portions 25*a* disposed at specified intervals in the longitudinal direction.

Figure 3:
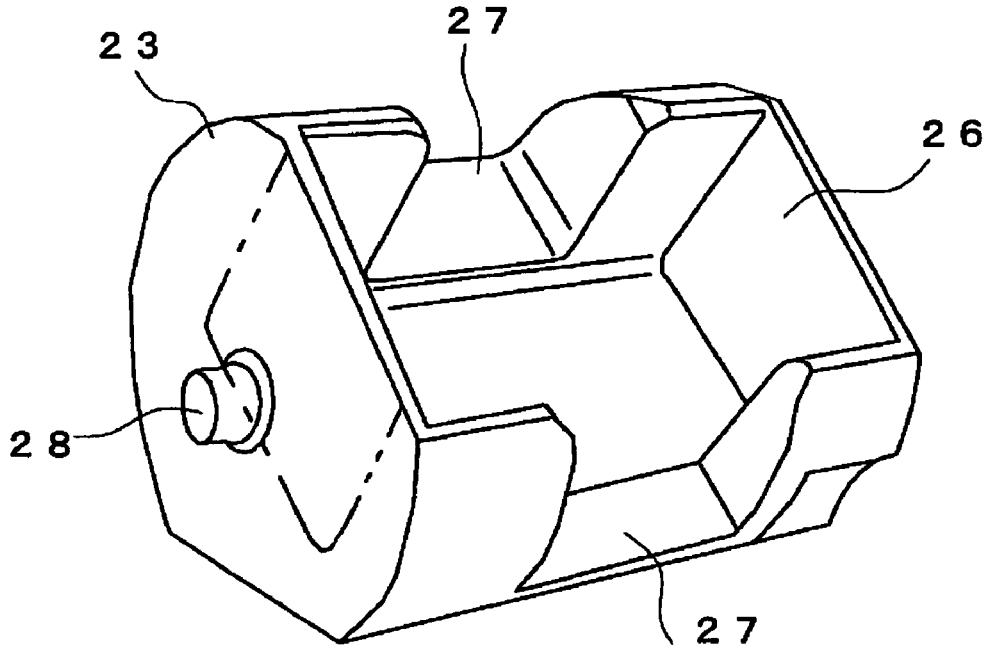
FIG. 3 is a perspective view showing a rotor that is usable in the cassette in FIG. 1.
Figure 4:
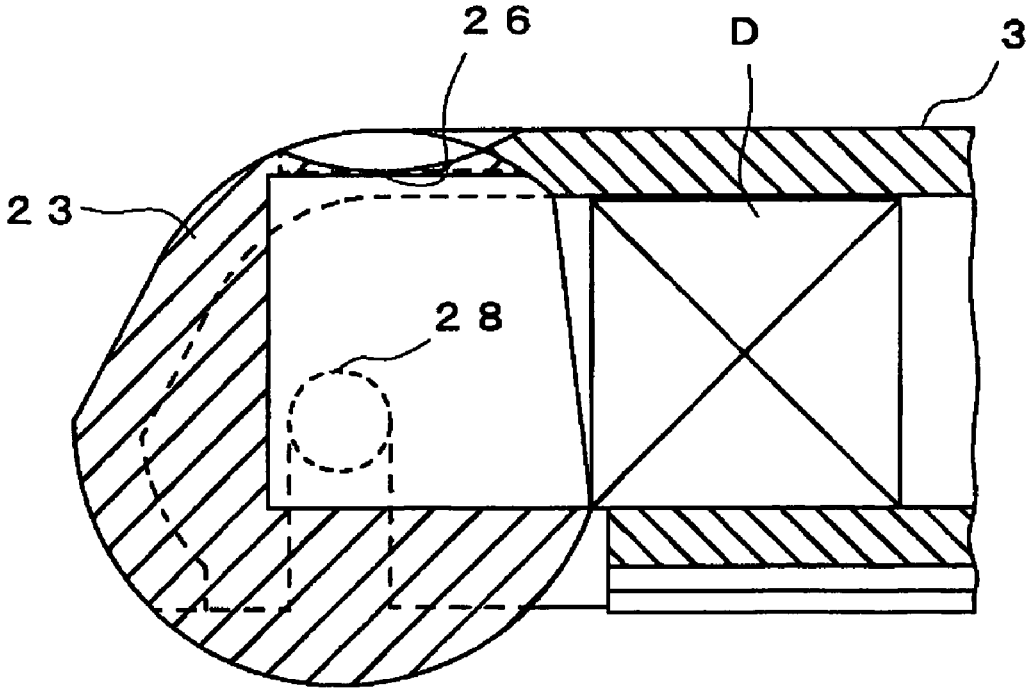
FIG. 4 is a cross sectional view showing the rotor that is usable in the cassette in FIG. 1.
Figure 5:
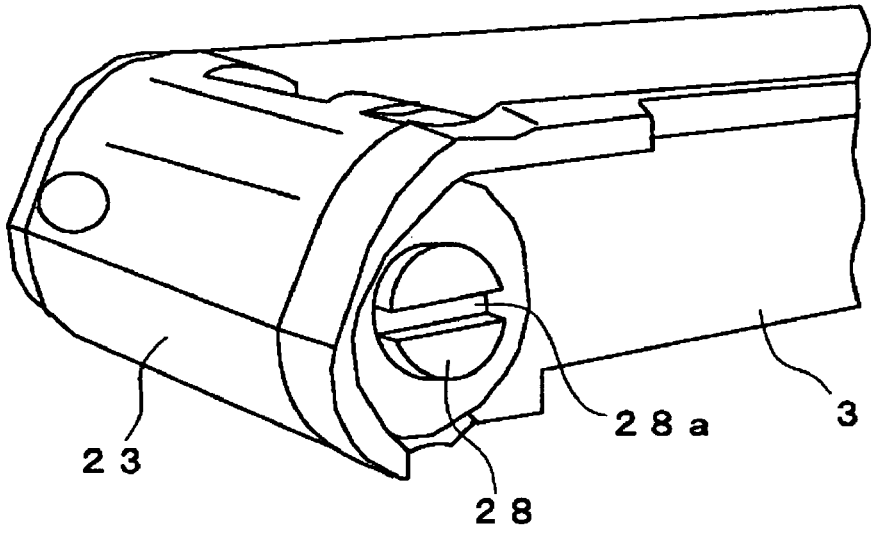
FIG. 5 is a fragmentary perspective view of the cassette as viewed diagonally from the right-hand side.
Figure 6:
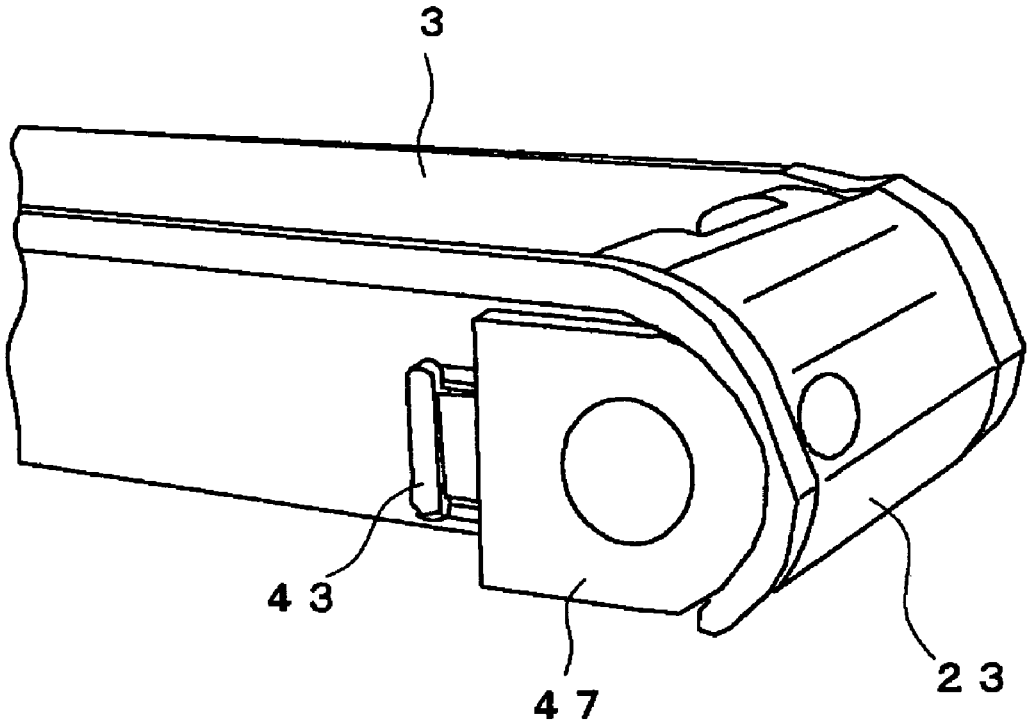
FIG. 6 is a fragmentary perspective view of the cassette as viewed diagonally from the left-hand side.

The rotor 23 includes small sized ones as shown in FIG. 2A for dispensing ampules and the like and large sized ones, as shown in FIG. 3 and FIG. 4, for dispensing boxes containing vials and the like. The rotor 23 has a holding recess portion 26 for holding the medicine D as shown in FIG. 3. A notch 27 is formed on both the side faces to permit the medicine D to be easily removed from the holding recess portion 26. A shaft portion 28 protrudes from the center portion on the end face of the rotor 23 and is rotatably supported by the cassette 3. A medicine name display portion formed from a label or the like on which the name of the medicine D contained in the cassette 3 is printed is provided on the front face of the rotor 23. Moreover, on the right-hand end face of the axis line of the shaft portion 28, as viewed from the front face of the rotor 23, an engagement recess portion 28*a* is formed as shown in FIG. 5. The engagement recess portion 28*a* engages with an engagement protruding portion 56*b* (see FIG. 10) of the driving mechanism 51.

Figure 7:
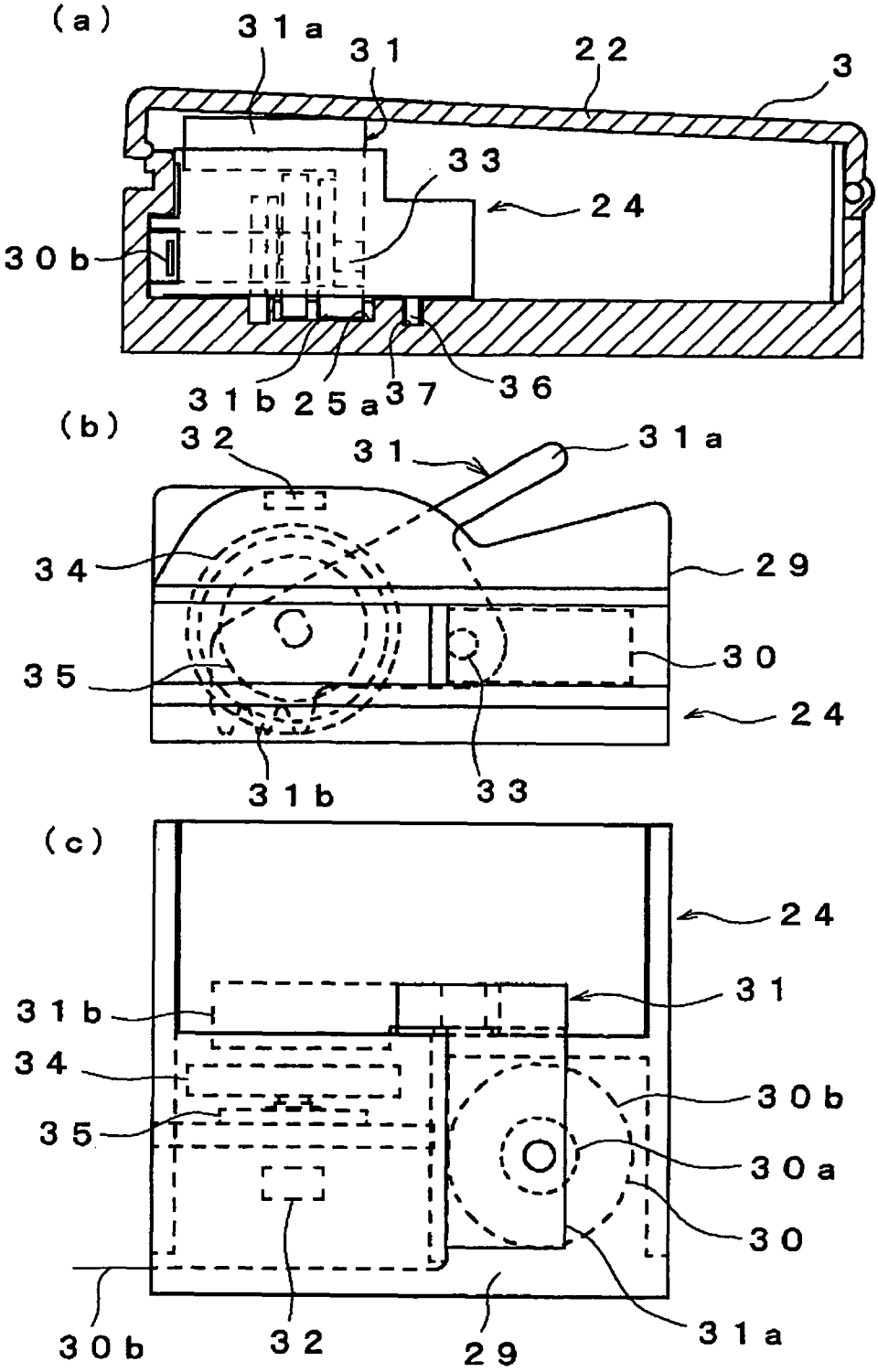
FIG. 7(*a*) is a cross sectional view showing a cassette having a pressing unit, FIG. 7(*b*) is a side view showing the pressing unit, and FIG. 7(*c*) is a plan view showing the pressing unit.

The pressing unit 24 is structured such that a constant force spring 30, an engagement member 31 and a magnet 32 as the medicine quantity detection means of the present invention are housed in a casing 29 as shown in FIG. 7(*a*) to FIG. 7(*c*). One end face of the casing 29 comes into contact with the medicine D contained in the cassette 3. The constant force spring 30, which is composed of a drum 30*a* and a spring portion 30*b* with a long length of a band plate wound onto the drum 30*a*, functions such that when a top end of the spring portion 30*b* is pulled out, the spring portion 30*b* returns to its original state with constant force. As the spring portion 30*b*, Conston® (trademark) springs and the like, which are available on the market, are used. The end of the spring portion 30*b* of the constant force spring 30 is pulled out from the casing 29, disposed along the side wall of the cassette 3, and fixed onto the front end side of the cassette 3. The engagement member 31 is disposed rotatably around a spindle 33. An operation portion 31*a* on its one end protrudes from the top face of the casing 29 and is pressed down when the cover article 22 is closed. Moreover, a gear portion 31*b* is formed on the other end of the engagement member 31, and is able to engage with each of the recess portions 25*a* of the engagement rack 25. In the engagement member 31, the gear portion 31*b* is heavier than the control device 33 so that the gear portion 31*b* can engage with the engagement rack 25 due to its own weight (it is naturally acceptable to arrange it so that the gear portion 31*b* is biased toward the engagement direction by a biasing means such as springs). On the lateral side of the gear portion 31*b* of the engagement member 31, an auxiliary gear 34 and an oil damper 35 are rotatably provided. The auxiliary gear 34 engages with each of the recess portions 25*a* of the engagement rack 25 as with the engagement member 31, and a load is applied during rotation by the function of the oil damper 35. With this arrangement, when the cover article 22 is closed after the medicines D are filled in the cassette 3, a failure in which the pressing unit 24 suddenly moves to collide with the contained medicines D may be prevented from occurring. It is to be noted that reference numeral 36 denotes a guide which slides and comes into contact with a guide groove 37 formed on the inner bottom face of the cassette 3 in the longitudinal direction so as to stabilize the operation of the pressing unit 24. The magnet 32 is disposed on the inner ceiling of the casing 29 and faces the reed switches 14 of the housing member 11.

Figure 8:
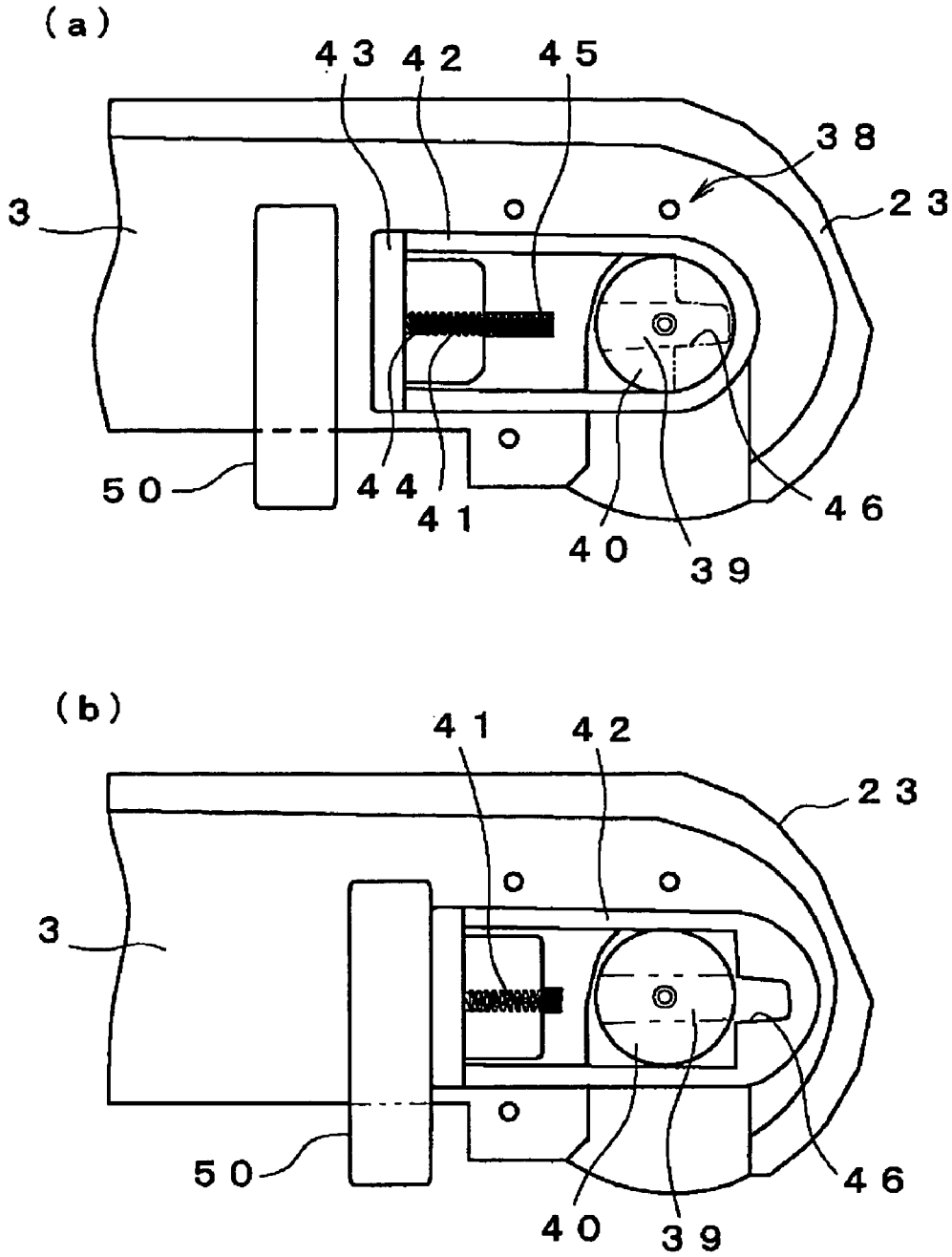
FIG. 8(*a*) is a left side view showing the front end portion of the cassette while a locking mechanism of a rotor is locked, and FIG. 8(*b*) is a left side view showing the front end portion of the cassette while the locking mechanism of the rotor is unlocked.
Figure 9:
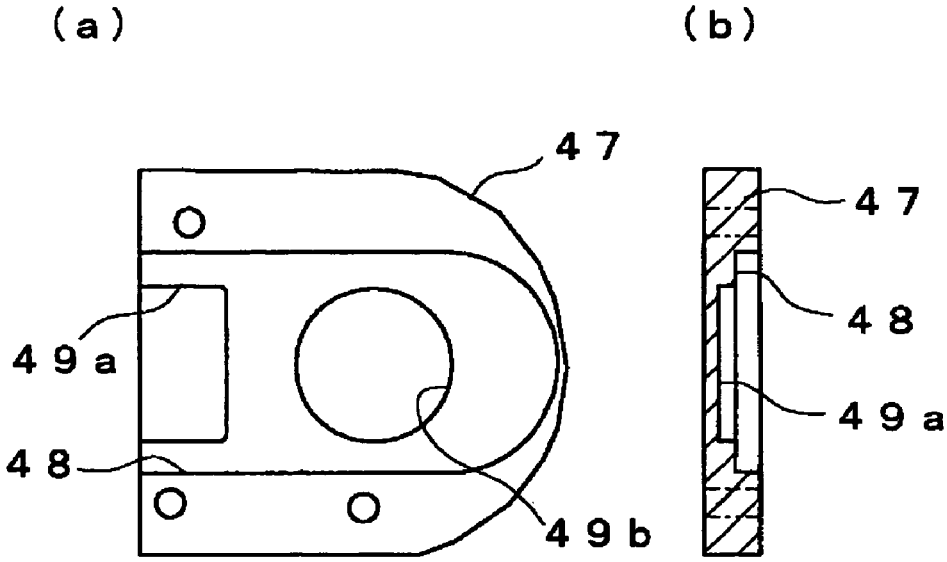
FIG. 9(*a*) is a front view showing a cover mounted on the cassette, and FIG. 9(*b*) is a cross sectional view of FIG. 9(*a*)

FIG. 8 and FIG. 9 show a locking mechanism 38 for preventing the rotor 23 from rotating when the cassette 3 is dismounted. A shaft portion 28 of the rotor 23 includes a disc 40 with a guide protrusion 39 formed thereon. Around the shaft portion 28, there is provided a lock frame 42 biased by a spring 41 toward the left-hand direction as viewed in the drawing. In a push-in portion 43 on the one end side of the lock frame 42, a protrusion 44 is formed on the inner face side. The protruding portions 44 and a groove portion 45, formed on the side face of the cassette 3, support the spring 41. Moreover, on the other end portion of the lock frame 42, an engagement groove 46 engaging with the guide protrusion 39 of the disc 40 is formed. The spring 41 and the lock frame 42 are covered with a cover 47 fixed onto the cassette 3 except the push-in portion 43. A slide groove 48 on which the lock frame 42 slides, a first relief recess portion 49*a* on which the push-in portion 43 can slide, and a second relief recess portion 49*b* on which the disc 40 can slide are formed on the cover 47. It is to be noted that a contact portion 50, with which the push-in portion 43 of the lock frame 42 comes into contact when the cassette 3 is mounted, is formed on the side face of the housing member 11.

Figure 10:
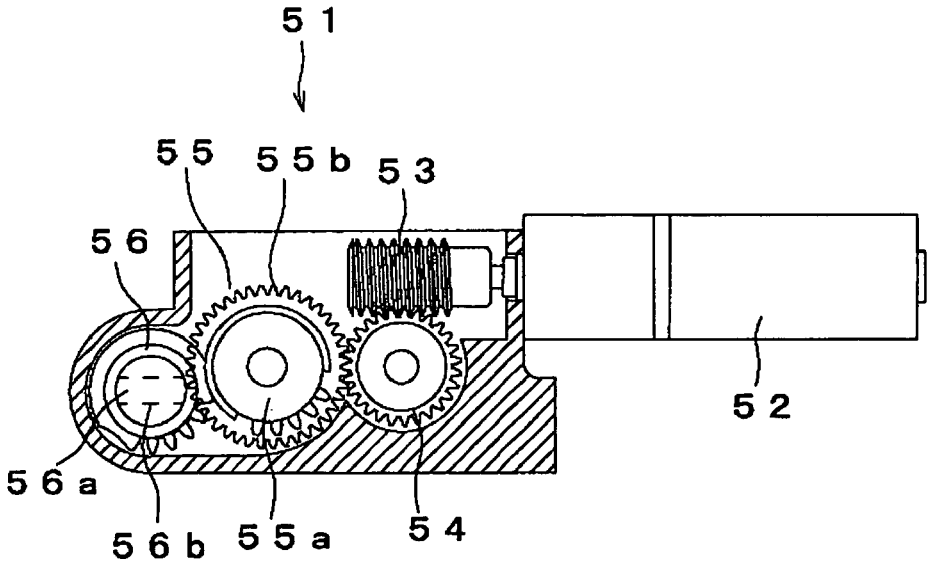
FIG. 10 is a cross sectional front view showing a rotary driving mechanism of the rotor.

As shown in FIG. 10, the driving mechanism 51 is composed of a motor 52, a worm gear 53, a worm wheel 54, an intermediate gear 55 and a driving gear 56. The worm gear 53 is fixed onto the rotating shaft of the motor 52, and the worm wheel 54 gears with the worm gear 53. The intermediate gear 55 is structured integrally with an intermittent gear 55*a* and a spur gear 55*b*, allowing the spur gear 55*b* to gear with the worm wheel 54 while allowing the intermittent gear 55*a* to gear with the driving gear 56. As the driving gear 56, an intermittent gear is used, and the top end face of its driving shaft 56*a* protrudes inward from the protruding portion 20 to form the rectangular engagement protruding portion 56*b*, which engages with the engagement recess portion 28*a* on the shaft portion 28 of the rotor 23.

When the motor 52 is driven in backward rotation, the driving force is transmitted to the driving gear 56 through the worm gear 53, the worm wheel 54 and the intermediate gear 55, and is further transmitted to the rotor 23 through the engagement between the engagement protruding portion 56*b* and the engagement recess portion 28*a* on the shaft portion 28 of the rotor 23. Consequently, the rotor 23 rotates to a dispensing position and a receiving position alternately, by which the medicines D contained in the cassette 3 are dispensed in sequence. In this case, if the rotor 23 rotates to a specified position, then the teeth portion of the intermittent gear 55*a* in the intermediate gear 55 does not gear with the teeth portion of the driving gear 56, and therefore any further rotation is prevented. Therefore, without high-accuracy management of the driving time of the motor 52, the rotor 23 can be accurately positioned at the dispensing position and the receiving position.

Figure 2B:
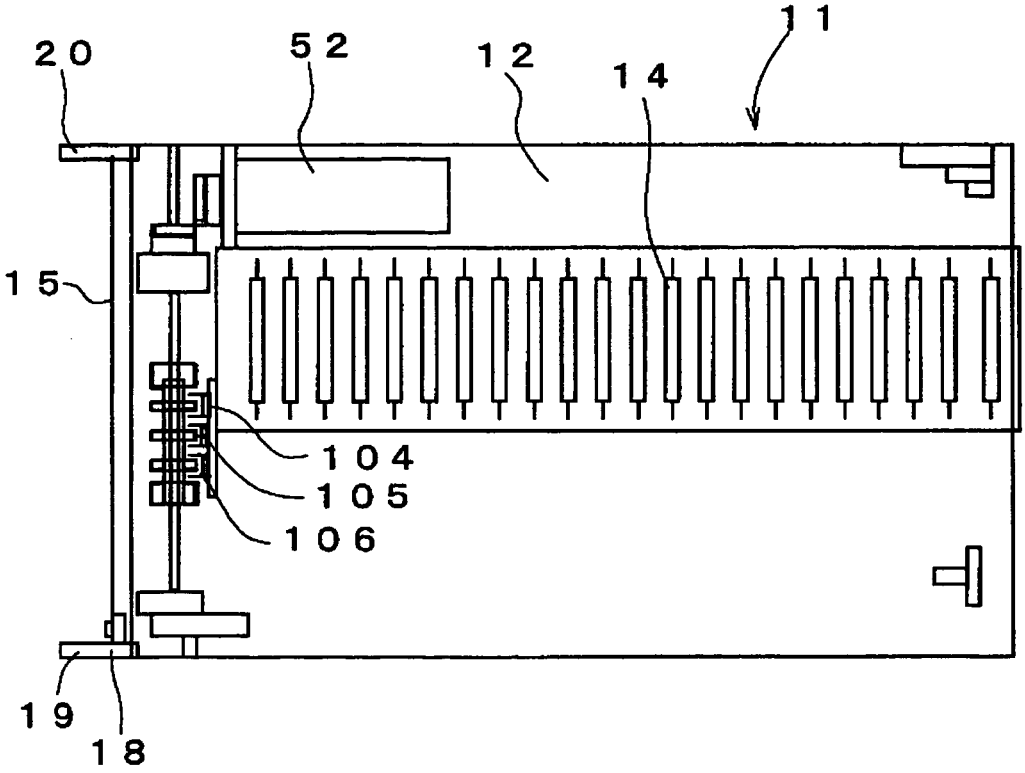

It is to be noted that the rotation position of the rotor 23 can be controlled by the following structure. That is, as shown in FIG. 2B, the driving force of the motor 52 is transmitted to a shaft portion 52*c* through gears 52*a*, 52*b*, and three protrusions 104*a*, 105*a*, 106*a* protruding from the shaft portion 52*c* are respectively detected by an open position sensor 104, a home position sensor 105, and an unlock position sensor 106, and based on these detection signals, on/off control of the motor 52 is performed.

As the user authentication device 7, various authentication means including user ID, password and user authentication and iris authentication can be employed. Only when a person pre-registered and authorized to dispense medicines is authenticated, the user authentication device 7 drives a stepping motor 52 or the like to allow the medicines D to be taken out.

Figure 11:
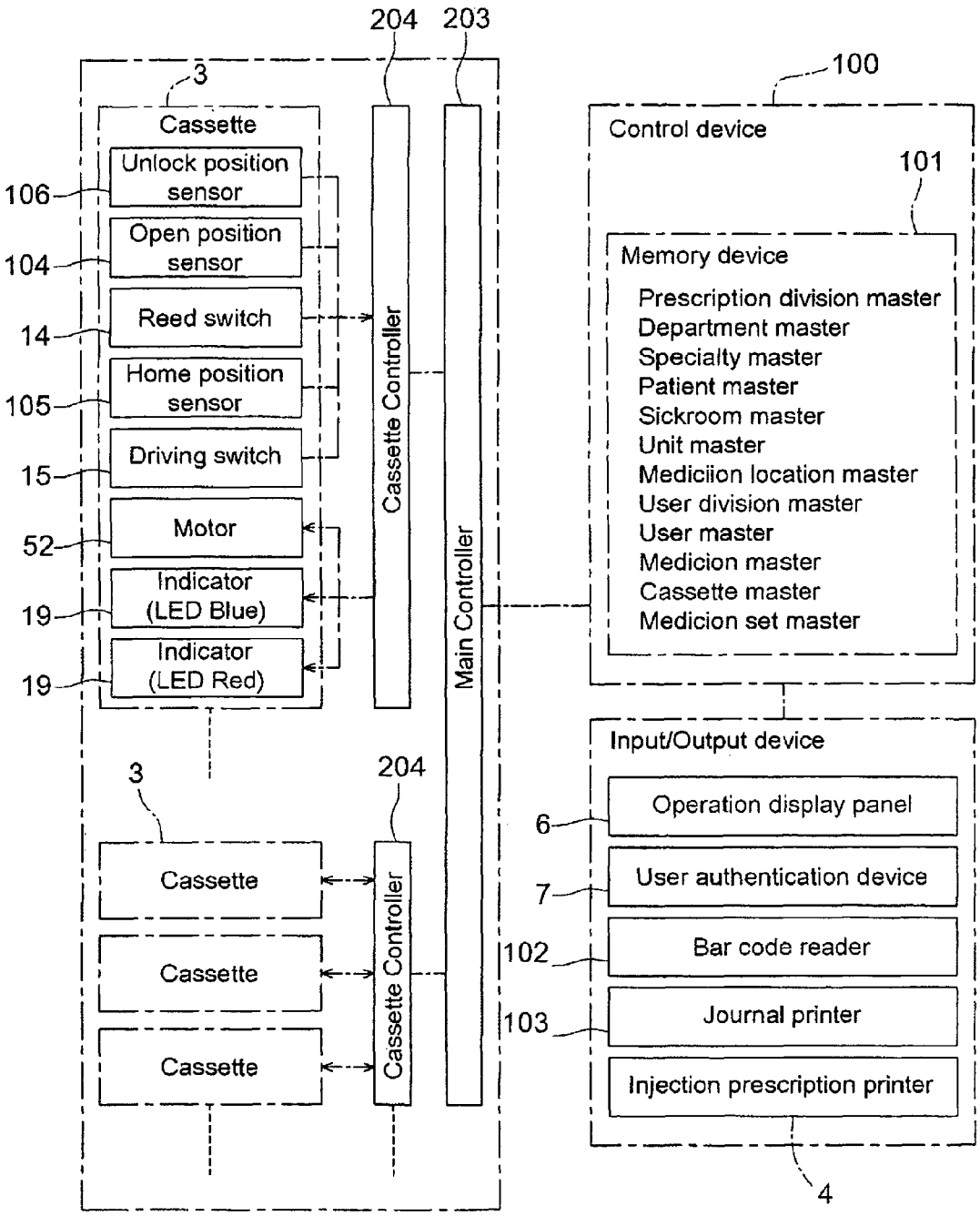
FIG. 11 is a block diagram showing a medicine dispensing apparatus according to an embodiment of the present invention.
Figure 12:
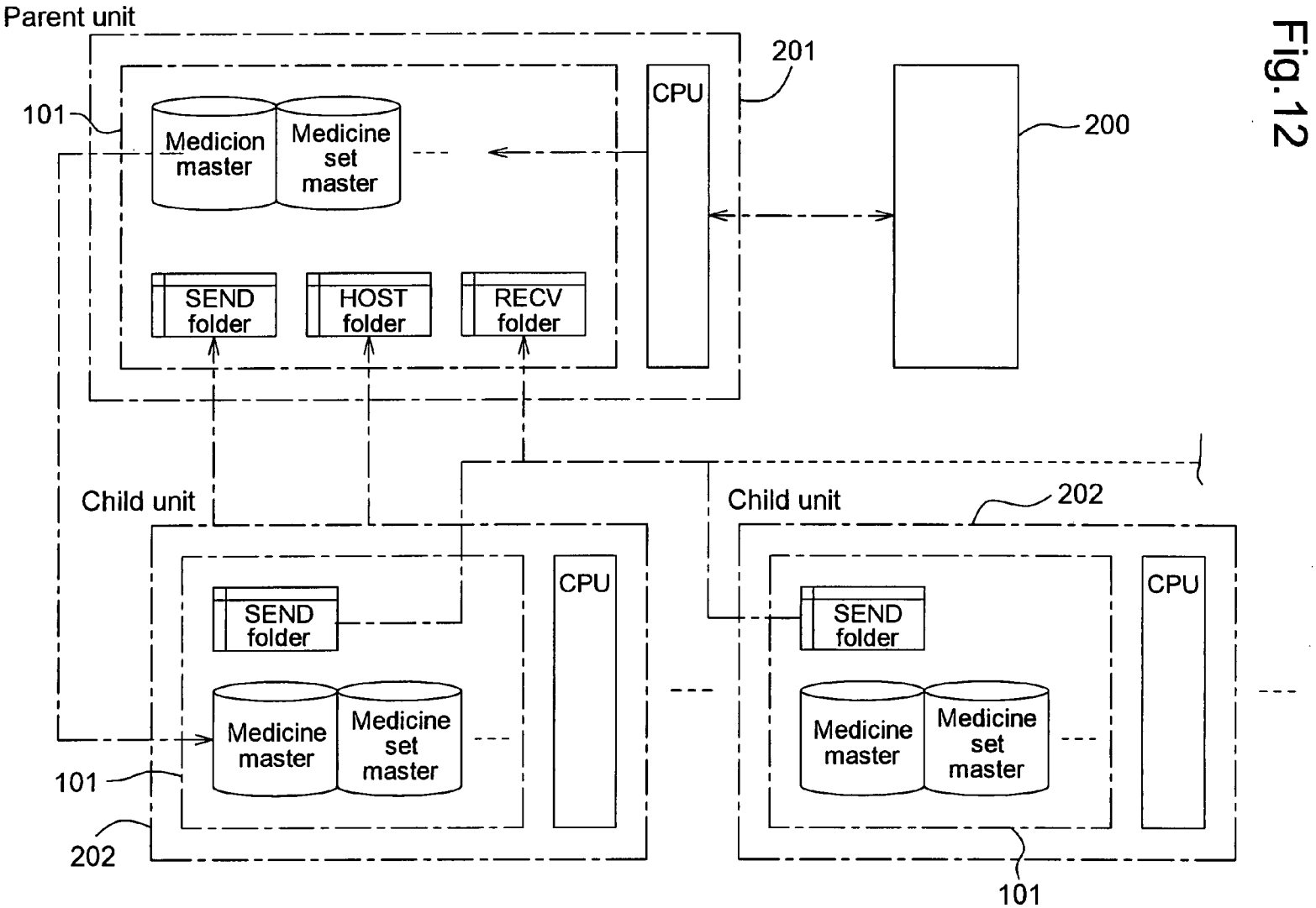
FIG. 12 is a block diagram showing a plurality of devices for dispensing medicine connected to a network.

As shown in FIG. 11, the control device 100 receives inputs of input signals from the user authentication device 7 as well as input signals and prescription data from the driving switch 15, the reed switch 14, the operation display panel 6 and the like. As shown in FIG. 12, the control device 100 outputs control signals to a main controller 203 in response to the input signals from a host computer 200 and the like, and controls the motor 52 and the indicator 19 of each of the cassettes 3 through a cassette controller 204. Moreover, detection signals from the sensors provided in each of the cassettes 3 are inputted into the main controller 203 through the cassette controller 204 and are read by the control device 100.

Figure 13:
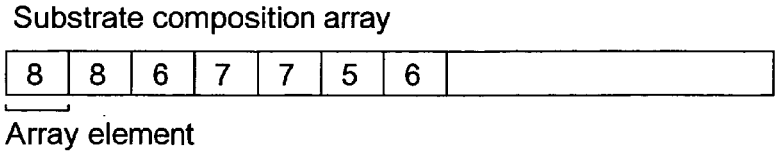
FIG. 13 is a view showing a substrate composition array storing the number of cassettes controlled by each cassette controller.
Figure 14:
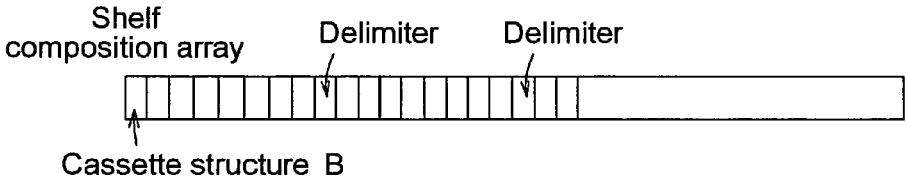
FIG. 14 is a view showing a shelf composition array composed of the substrate composition array and a cassette structure.

The main controller 203 creates shelf composition arrays from data (cassette structure B) read from each of the cassettes 3 and a substrate composition array when power is turned on. The cassette structure B is composed of information on each of the cassettes 3 (cassette information) including a cassette No., a quantity of inventory of medicines, a cassette state and a communication state. The cassette structure B is created, for example, when the cassette 3 is mounted on the stock shelf 2, by reading a detection target portion (e.g., bar code) provided on the cassette 3 by a sensor (not shown) provided on the stock shelf 2, making reference to the medicine master or other master files, and taking the input signals or others from the reed switch 14 and the like into consideration. The substrate composition array is an array composed of array elements each representing the number of cassettes controlled by each of the cassette controllers 204 as shown in FIG. 13. As shown in FIG. 14, each array element in the substrate composition array is expanded per cassette and the cassette structure B corresponding to each of the expanded cassettes 3 is stored in the shelf composition array.

Thus, the shelf composition array is created when power is turned on, so that a change in layout of the cassettes 3 can be flexibly supported. More specifically, when a quantity of the cassettes 3 managed by the cassette controller 204 is changed, simply changing the array elements in the substrate composition array allows the content of the change to be read when power is turned on so as to support the change. Moreover, in the case of the parent-child cassettes (a plurality of cassettes 3 containing identical medicines), the cassette information (later-described cassette structure A) possessed by every cassette is grouped when power is turned on, and the cassette of the least number is regarded as a parent cassette while the others are regarded as child cassettes as described before. Then, an accumulated total value of the number of medicines dispensed from the parent-child cassettes is managed by the parent cassette as the total number of the dispensed medicines D. It is to be noted that the number of dispensed medicines D from each cassette 3 is managed by each cassette 3. Thus, creating the shelf composition array is extremely effective since it eliminates the necessity of changing the setting of every medicine dispensing apparatus. It is to be noted that in the conventional example, the parent-child cassette setting is registered on the main frame (main controller side) and when dispensation data is sent to the parent-child cassettes, the main frame needs to allot the dispensing number to the parent-child cassettes.

Figure 15:
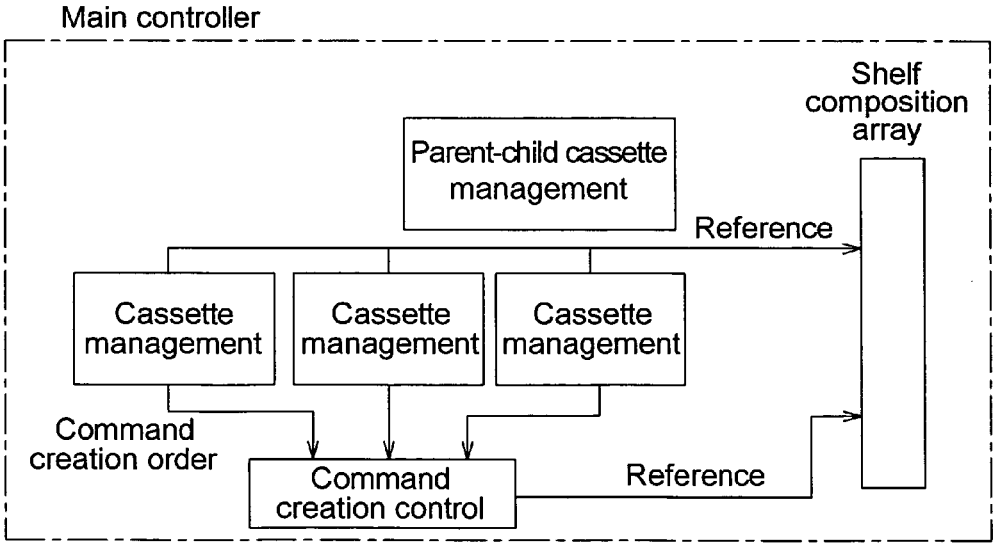
FIG. 15 is a block diagram showing each control exercised by a main controller.

Moreover, the main controller 203 executes management of the parent-child cassettes, management of respective cassettes and command creation control as shown in FIG. 15.

In the parent-child cassette management, the cassette No., the dispensation request number (of identical medicines), the dispensed number (a medicine count), the dispensed number (a cassette count), the dispensation permitted number (for the cassette 3), the number of parent-child cassettes (the number of cassettes 3 containing identical medicines) and the like are managed as a cassette structure A. Consequently, parameter setting on the device side is not necessary and management becomes operable by data. Moreover, the number of cassettes 3 containing identical medicines can be freely set free from numeral limits. For example, all the cassettes 3 mounted on a certain medicine dispensing apparatus may contain the identical medicines.

In the cassette management, based on the prescription data inputted from the control device 100, reference is made to the shelf composition array created when power is turned on so as to manage whether medicines can be dispensed from each cassette 3 in conformity with the prescription data, and command creation orders are outputted.

Figures 16, 17, 18, 19:
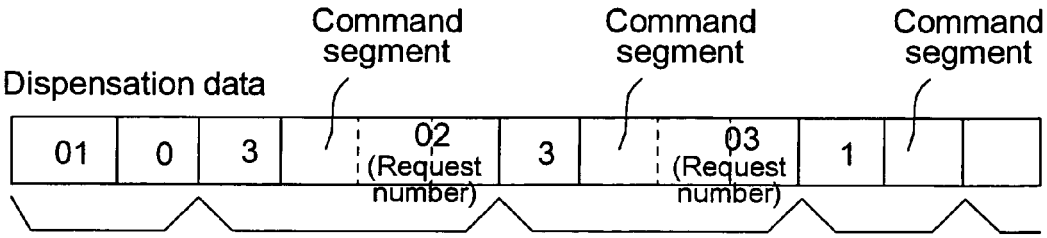
FIG. 16 is a view showing dispensation data created by a control device based on inputted prescription data.
FIG. 17 is a view showing a medicine master stored in a storage means.
FIG. 18 is a view showing a medicine location master stored in the storage means.
FIG. 19 is a view showing a cassette master stored in the storage means.

In the command creation control, after reference is made to the shelf composition array in the cassette management, the cassette structure B composed of a cassette No., a number of inventory of medicines, a cassette state, a communication state and the like is created. Moreover, in conformity to the command creation order outputted from each cassette management, the shelf composition array is referred and medicine dispensation processing is summarized per cassette controller 204 to create dispensation data shown in FIG. 16. In FIG. 16, the order data of the first cassette 3 is not present (shown by 0 in FIG. 16), while the second and third cassettes 3 have the order data composed of a command segment and the number of requested medicines and having the data length of 3, the order data requesting two medicines to be dispensed. It is to be noted that the fourth data has the data length of 1 and is composed of only the command segment, indicating that the data does not involve the dispensation control and the state of the cassette 3 is simply under checking (shown by . . . in the drawing). Thus, the dispensation data is effective since it has a variable data length and therefore a plurality of orders can be sent as one data.

In the storage device 101, various master files are stored as shown in FIG. 11. The master files include a specialty master and a department master as well as a medicine master, a medicine location master, a cassette master and a medicine set master.

The medicine master is, as shown in FIG. 17, composed of the following items: a medicine code; a medicine name; a unit; a chime; and a voice. The medicine code refers to a unique code to identify the medicine and is a merchandise item of the stocked medicine. The medicine name refers to the name of the medicine. In the unit 1, a medicine count, which is a unit of dispensing, is stored, and in the unit 2, a capacity of one medicine (e.g., ml, mg) is stored. It is to be noted that the unit 3 is a reserve unit. In the chime, sound data which is outputted when the pertinent medicine is dispersed is stored, and the output sound can be freely changed. In the voice, the medicine name and the quantity are stored in the form of voice data.

As shown in FIG. 18, the medicine location master is composed of the following items: a department, a medicine code, location information, a constant, an inventory, and a cassette No. In the department, data indicating the location where the medicine dispensing apparatus is installed, e.g., "third ward" and "outpatient ward", is stored. In the medicine code, a code number unique to each medicine is stored as in the medicine master. Based on the medicine code, data call and association are executed. The location information is composed of three items: "unlocated" indicating that the cassette 3 containing the pertinent medicine is not located in the cassette 3; "manual dispensing" indicating that pharmacists manually dispense the medicine independently of the medicine dispensing apparatus; and "machine" indicating that the medicine is automatically dispensed from the medicine dispensing apparatus based on the prescription data. In the constant, a standard quantity of inventory, e.g., a probable value of consumption for a unit period set by each ward, is stored. In the inventory, a quantity of inventory per medicine is stored. In the case where the same kind of medicine is stored in a plurality of the cassettes 3, their total sum equals the inventory In the cassette number, the number of cassettes 3 containing identical medicine is stored.

Thus, the medicine master and the medicine location master are provided separately, which allows the data stored in the medicine master to be versatile.

The cassette master is, as shown in FIG. 19, composed of the following items: a department; a medicine code; a cassette No.; and an inventory.

Thus, managing the quantity of inventory of medicines in both the medicine location master and the cassette master makes it possible to employ management methods ideal for usages. More particularly, in the medicine location master, not only the medicine dispensing apparatus but also the quantity of inventory of all the medicines including dispensable medicines are managed. In the cassette master, the quantity of inventory of medicines in each cassette mounted on the medicine dispensing apparatus is managed.

In the medicine set master, in the case where medicines D to be used is predetermined such as the case of operations, a plurality of the medicines D to be used are all registered as a group. Therefore, when the medicines D are dispensed for, for example, the operation for appendicitis, the medicines D can be dispensed easily based on the data registered on the medicine set master. In this case, the medicine dispensing apparatus to dispense these medicines D may be a plurality of units.

The devices for dispensing medicine (clients) structure as shown above are located in various departments, and are connected to the host computer (server) 200 through LAN (local Area Network) as shown in FIG. 12. Among the plurality of devices for dispensing medicine, one is a parent unit 201 and the others are child units 202.

The same master file is stored in the parent unit 201 and in each of the child units 202. The parent unit 201 has a SEND (send) folder, a RECV (receive) folder and a HOST (host) holder, whereas the child unit 202 has only a SEND folder.

Each of the folders in the parent unit 201 has a plurality of lower-level folders (department folders: 0601 to 06xx) corresponding to each of the child units 202. When the data content of any one of the master files has been updated, the update report is written onto each of the department folders in the SEND folder. Based on the updated data, data in other child units 202 (other than the child unit which has received data update notification) is also updated. In each of the department folders in the HOST folder, prescription data created based on the prescription data inputted from the host computer is stored. The prescription data is composed of a patient attribute (ID, name, date of birth, division (department)) and prescription specifications (medicine code, prescription quantity, number of times), and a management No. is automatically allotted. The dispensation data is composed of items: a command segment; a dispensing quantity; the number of cassettes; and a cassette No., and is created based on the prescription specifications of the prescription data with the allotted management No. and with reference to the medicine location master and the cassette master.

Figure 21:
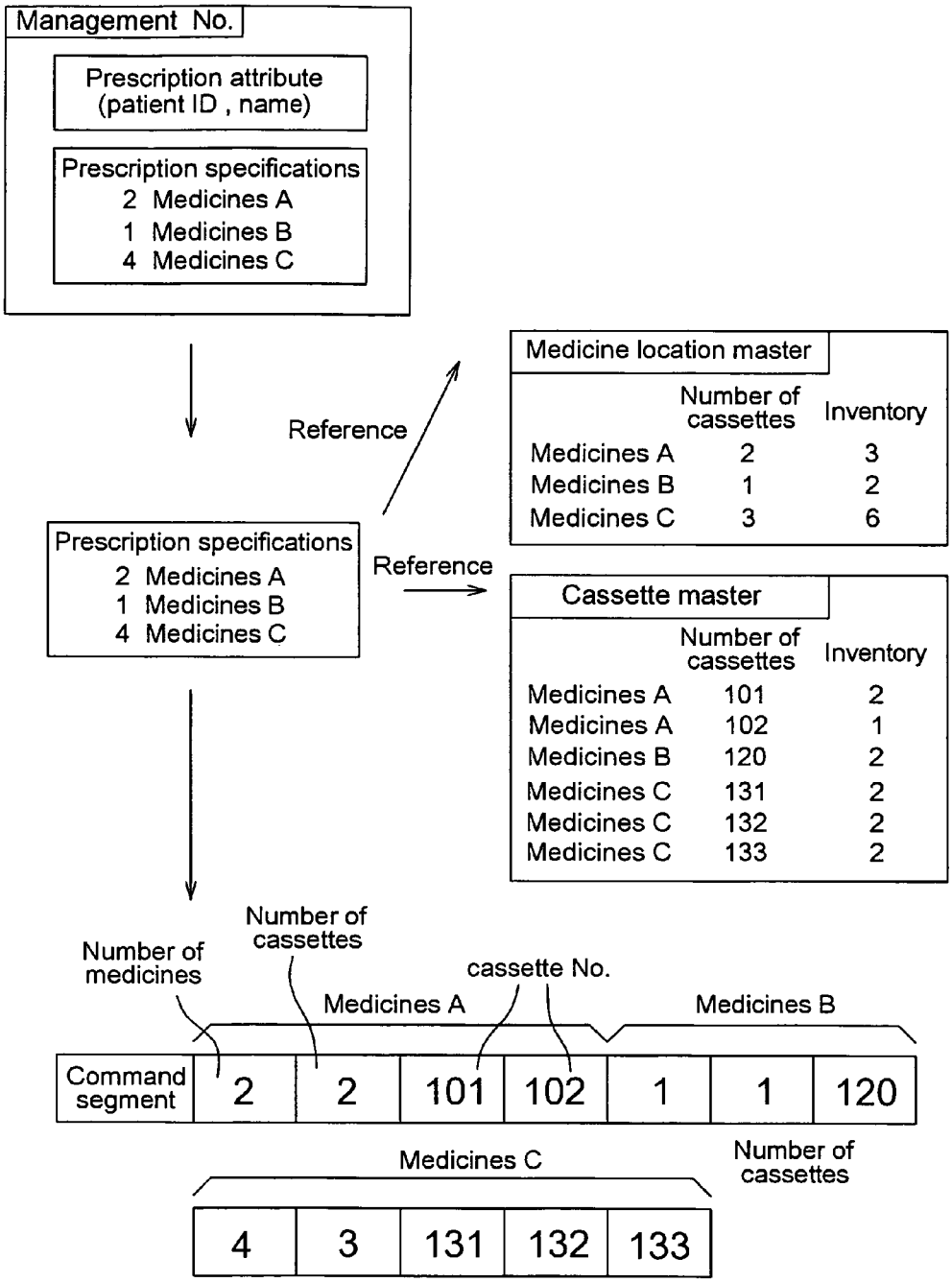
FIG. 21 is a view showing an example of dispensation data created by the control device.

FIG. 21 shows an example of creating dispensation data. More particularly, prescription specifications (2 medicines A, 1 medicine B, 4 medicines C) are read from the prescription data and the medicine location master and the cassette master are referred. The medicine location master incorporates data indicating that the medicines A are contained in the cassettes 3 in two locations with the inventory thereof (the total number of the medicines A contained in the medicine dispensing apparatus) being three, the medicines B are contained in the cassette 3 in one location with the inventory thereof being one, and the medicines C are contained in the cassettes 3 in three locations with the inventory thereof being six. Moreover, the cassette master incorporates the data indicating that two medicines A are contained in the cassette 3 (cassette No. 101) and one medicine A is contained in the cassette 3 (cassette No. 102), two medicines B are contained in the cassette 3 (cassette No. 120), and two medicines C are contained in each of the cassettes 3 (cassette Nos. 131, 132, 133). Based on these data sets, with the command segment allotted corresponding to the management No. as one unit, the dispensation data permutated in the order of the number of each medicine, the number of cassettes and the cassette No. is created.

The child unit 202 periodically makes reference to the HOST folder and the SEND folder in the parent unit 201 (herein the reference period is set at 60 min. for the SEND folder and 100 msec. for the HOST folder), and when new data has been stored, the data is acquired.

When new dispensation data is stored in a department folder in the HOST folder in the parent unit 201, the child unit 202 of the pertinent department obtains the dispensation data. At this point, in the department folder in the HOST folder, the acquisition the dispensation data is recorded as a history record. Then, when the medicines D stored in the dispensation data are dispensed in the child unit 202, the contents of the master data (medicine master and cassette master) of the child unit 202 are updated and prescribed dispensation complete information is outputted from the SEND folder of the child unit 202 to the RECV folder of the parent unit 201.

Once the prescribed dispensation complete information is sent from the child unit 202 to the RECV folder, the parent unit 201 reads the data sent at a constant frequency and updates the master data, while at the same time, storing the update report in the department folders among the department folders corresponding to the respective child units in the SEND folder, the department folders corresponding to child units 202 other than the child unit 202 which sent the prescribed dispensation complete information. Consequently, these other child units 202 refer to the update report data and update their master data.

Moreover, once the data reporting that the master data is updated is stored in the SEND folder in the parent unit 201, each of the child units 202 makes reference to the data, by which the data updated by each master file in the parent unit 201 is read by the master files of the child units 202 and so the master files of all the child units are updated.

Thus, various master files in the storage device 101 of a certain medicine dispensing apparatus is backed up by the storage devices 101 of all the other devices for dispensing medicine. Therefore, even if errors occur in one medicine dispensing apparatus and desired medicines cannot be dispensed therefrom, the medicines can easily be dispensed from other devices for dispensing medicine containing identical medicines. Moreover, when patients change their wards or in other occasions, the dispensation department of the medicines can be freely changed and so flexible response to changes is offered. Furthermore, after one dispensation is performed, the prescription data may be updated in all the devices for dispensing medicine, thereby allowing reliable prevention of duplicated dispensation.

Moreover, when the master data is updated in a certain child unit 202, the update report is stored in the SEND folder and is sent to the RECV folder in the parent unit 201. In the parent unit 201, the master data is updated based on the updated data sent to the RECV folder and the update report data is stored in the SEND folder.

Thus, exchange of data between the parent unit 201 and all the child units 202 allows the master data in each of the units to be identical. Therefore, even if the network is disconnected, the parent unit 201 and the child units 202 can continue their processing independently. Moreover, if any processing is executed in the parent unit 201 and each of the child units 202, leading to update of the master data while the network is disconnected, the data is exchanged once the network connection is recovered, which allows the master data to be updated and the data content of the master data in all the units to be identical.

It is to be noted that both in the support portion 201 and the child units 202, addition of operators, i.e., registration of fingerprints necessary for later-described fingerprint authentication is available. Once fingerprint data is registered on a fingerprint registration file in the parent unit 201, the information is automatically read by all the child units 202 at a constant frequency, and is registered on the fingerprint registration file in each of the child units 202. Moreover, when fingerprint data is registered on the fingerprint registration file in the child unit 202, the fingerprint data is once stored in the fingerprint registration file in the parent unit 201, and after that, as is the former case, other child units 202 read the data at a constant frequency, by which the data is registered on each of the fingerprint registration files. It goes without saying that the fingerprint data is updated only when the read data is determined to be the latest data by comparison of the update date.

Conventionally, database backup systems disclosed, for example, in JP 2000-112801 A and JP 2003-3456940 A have publicly known, and these database backup systems have a plurality of databases, one of which is a master database. When the master database malfunctions, other database can be used as the master database to execute operation services.

However, in these database backup systems, data update is performed between databases provided separately from devices (client devices), and so if such system that a plurality of devices for dispensing medicine (client devices) are connected to a network as in the case of the present embodiment is employed and if the network is disconnected, then the medicine dispensation processing cannot be continued any longer.

Contrary to this, in the devices for dispensing medicine according to the present embodiment, each medicine dispensing apparatus has master files and periodically executes data update, so that if the network is disconnected, the medicine dispensation processing can be continued. More particularly, it is an object of the devices for dispensing medicine connected to the network according to the present embodiment to be able to continue the appropriate medicine dispensation processing even during disconnection of the network.

Description is now given of the operation of the above-structured devices for dispensing medicine.

In the medicine dispensing apparatus, medicines D are contained in a row in each of the cassettes 3. In this state, the contained medicines D receive the action of the pressing force from the constant force spring 30 through the pressing unit 24, so that the medicine D positioned on the front-end portion is held in the holding recess portion 26 of the rotor 23 which is positioned at the receiving position.

The control device 100 executes free dispensation processing in which pharmacists manually dispense the medicine, prescribed dispensation processing in which the medicine is automatically dispensed based on the prescription data inputted from the host computer, and medicine specification/dispensation processing in which pharmacists directly input prescription data and dispense medicines. Each processing will be described hereinbelow.

(Free Dispensation Processing)

Figure 22:
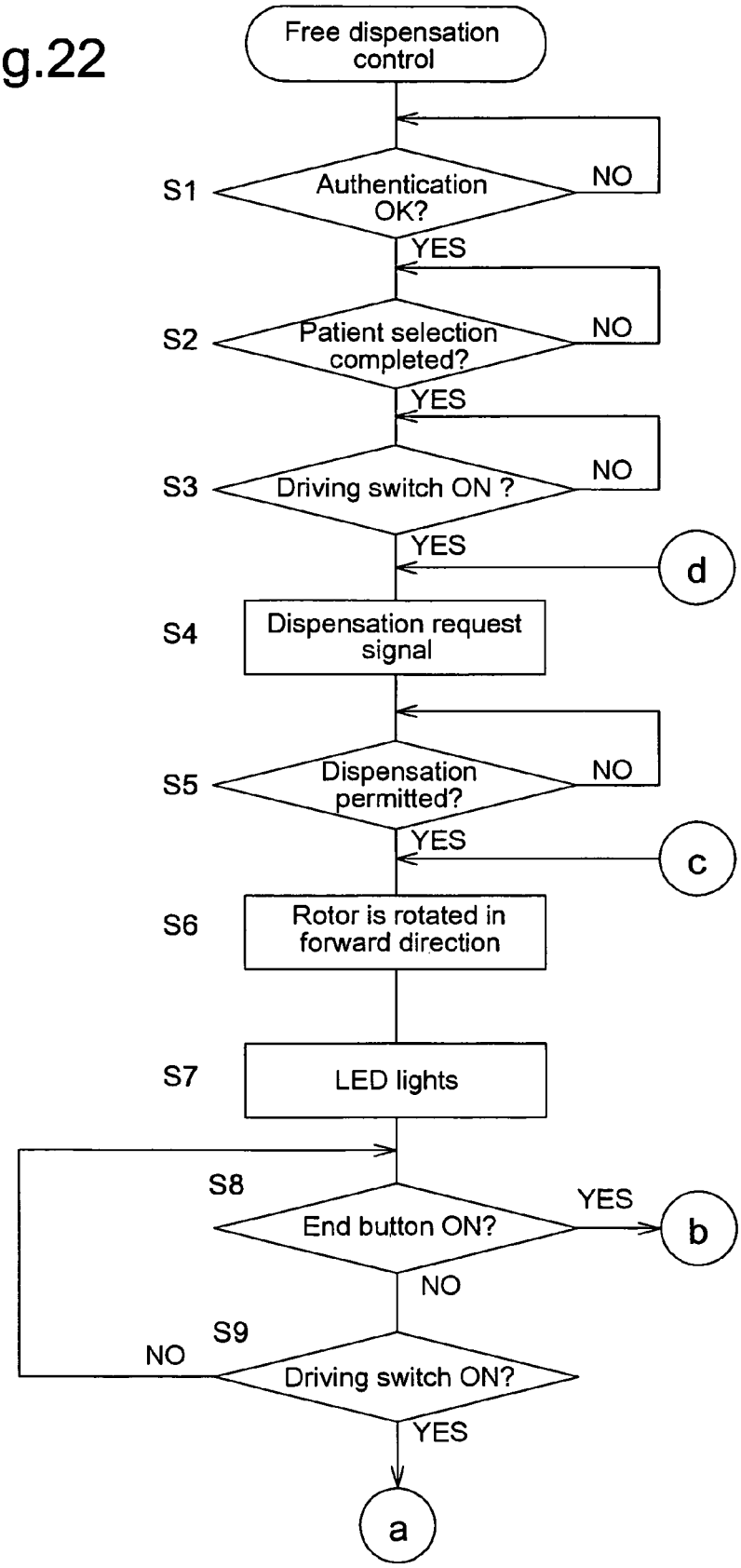
FIG. 22 is a flowchart showing free dispensation processing.
Figure 23:
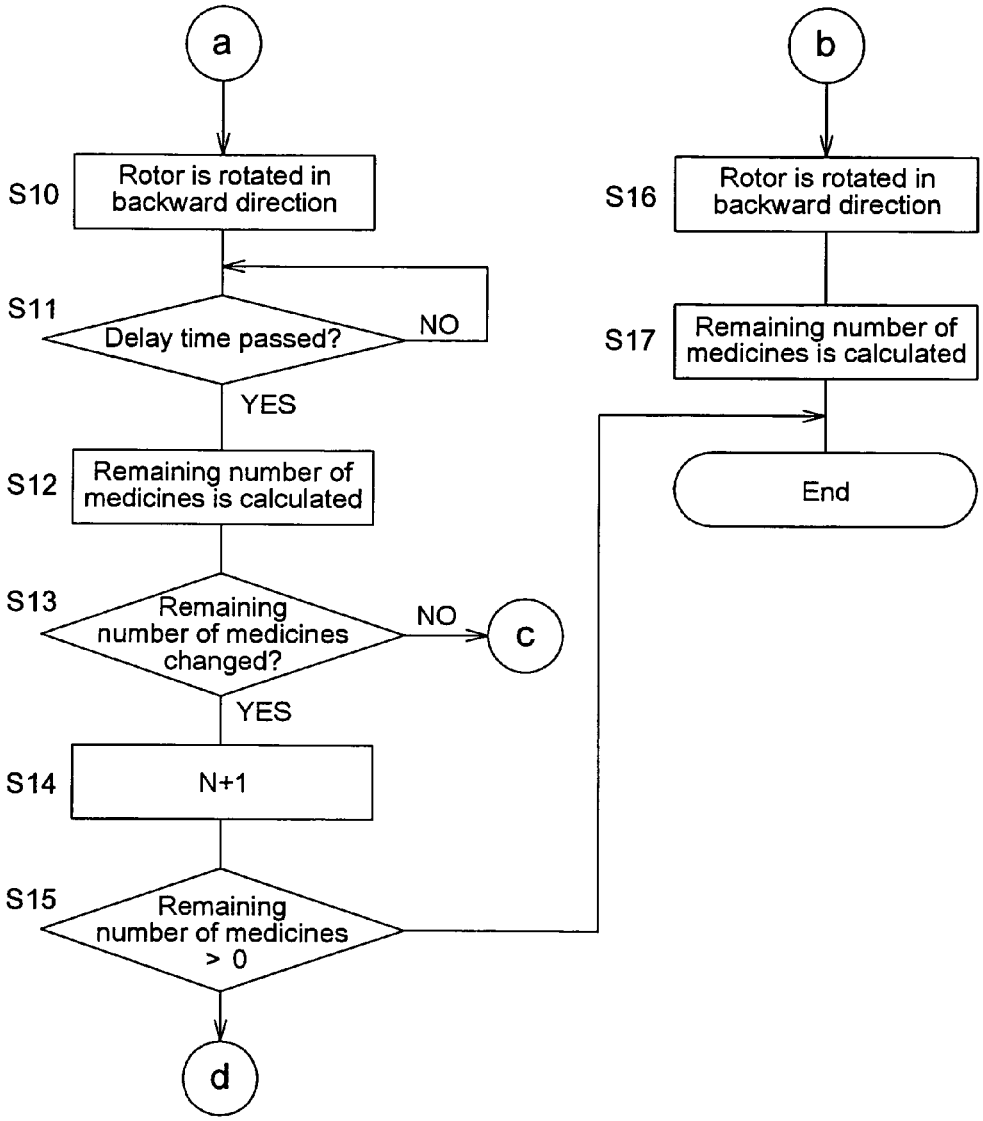
FIG. 23 is a flowchart showing free dispensation processing.
Figure 27:
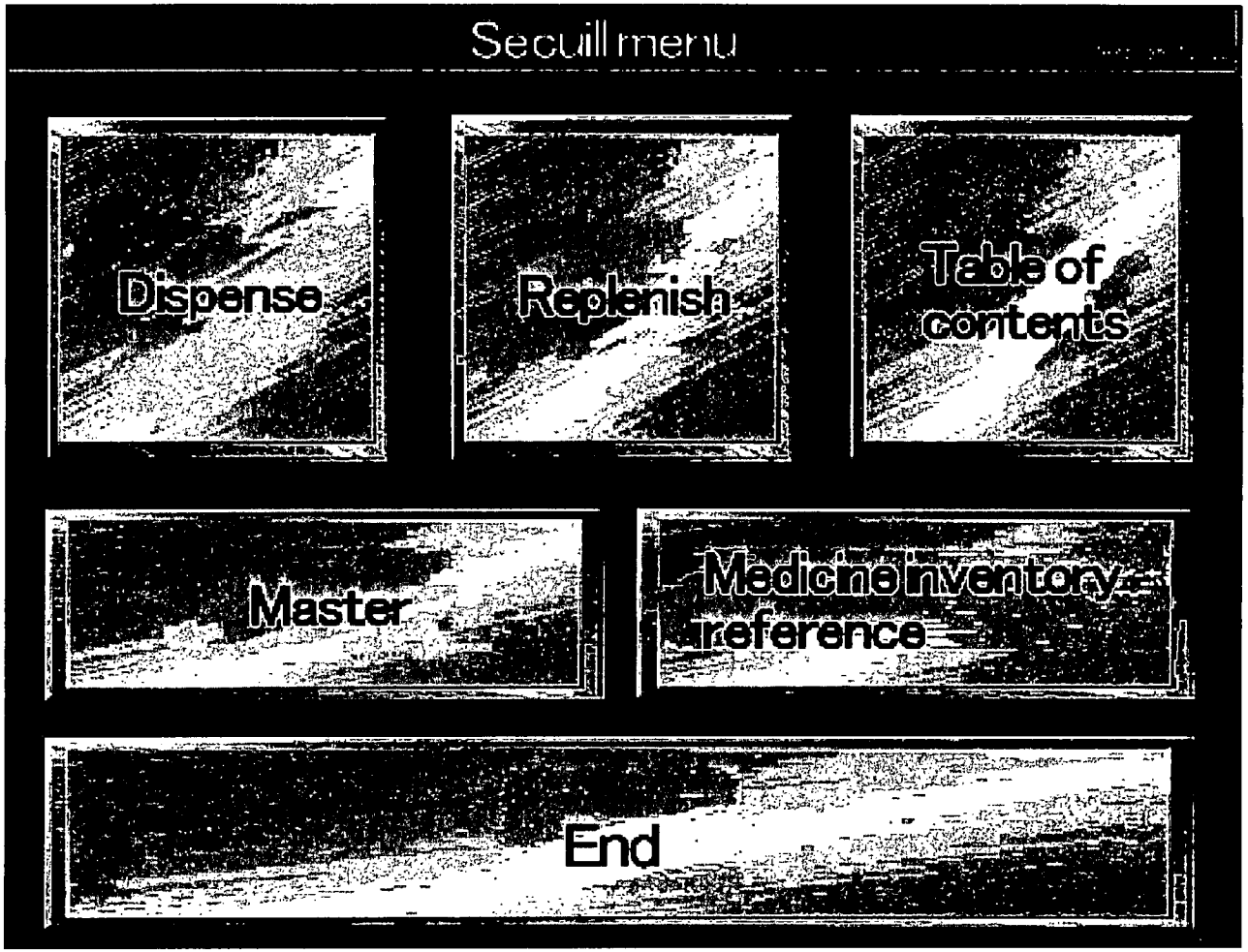
FIG. 27 is a view showing a menu screen displayed on an operation display screen.
Figure 28:
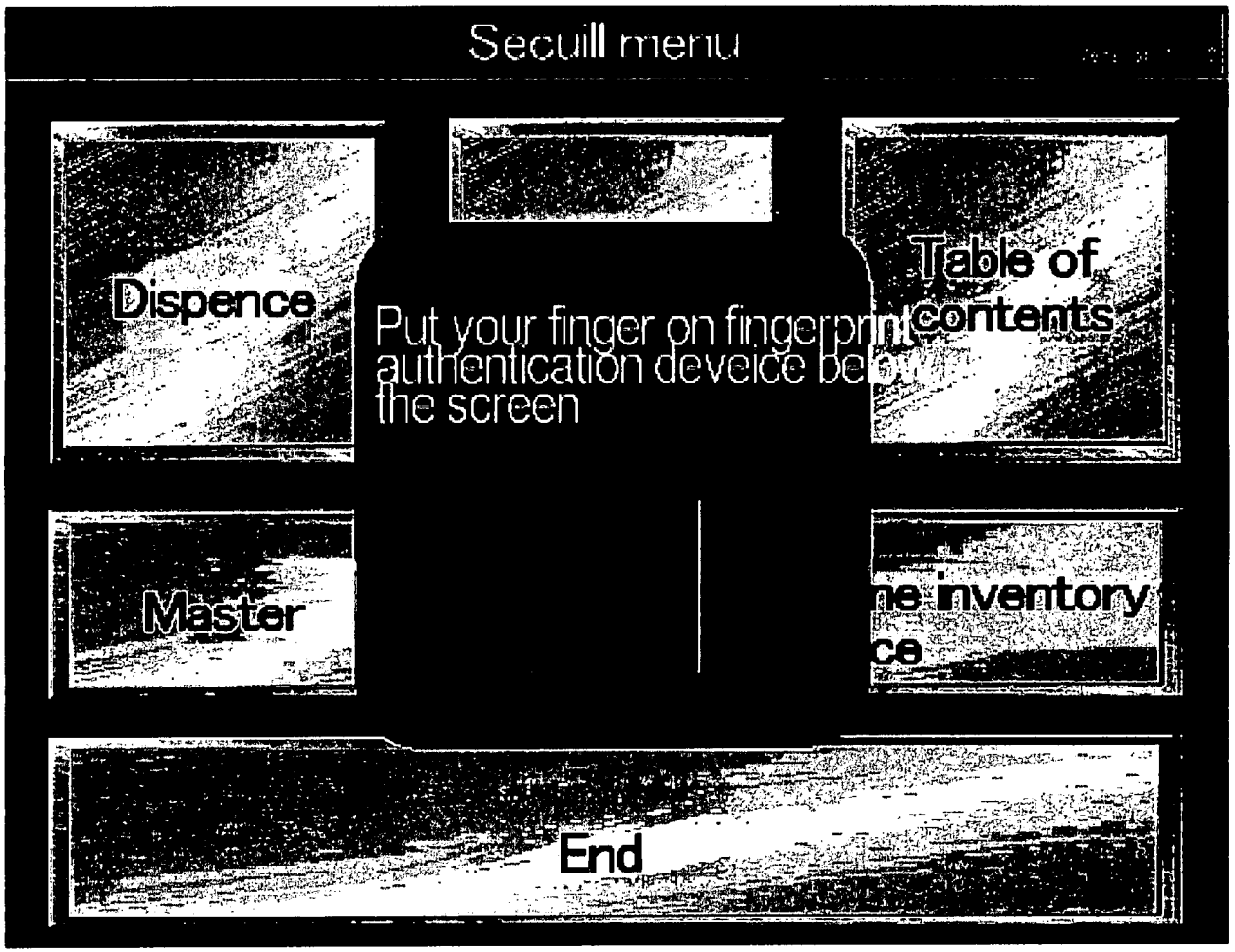
FIG. 28 is a view showing the menu screen of FIG. 27 with a fingerprint authentication screen popped up.
Figure 29:
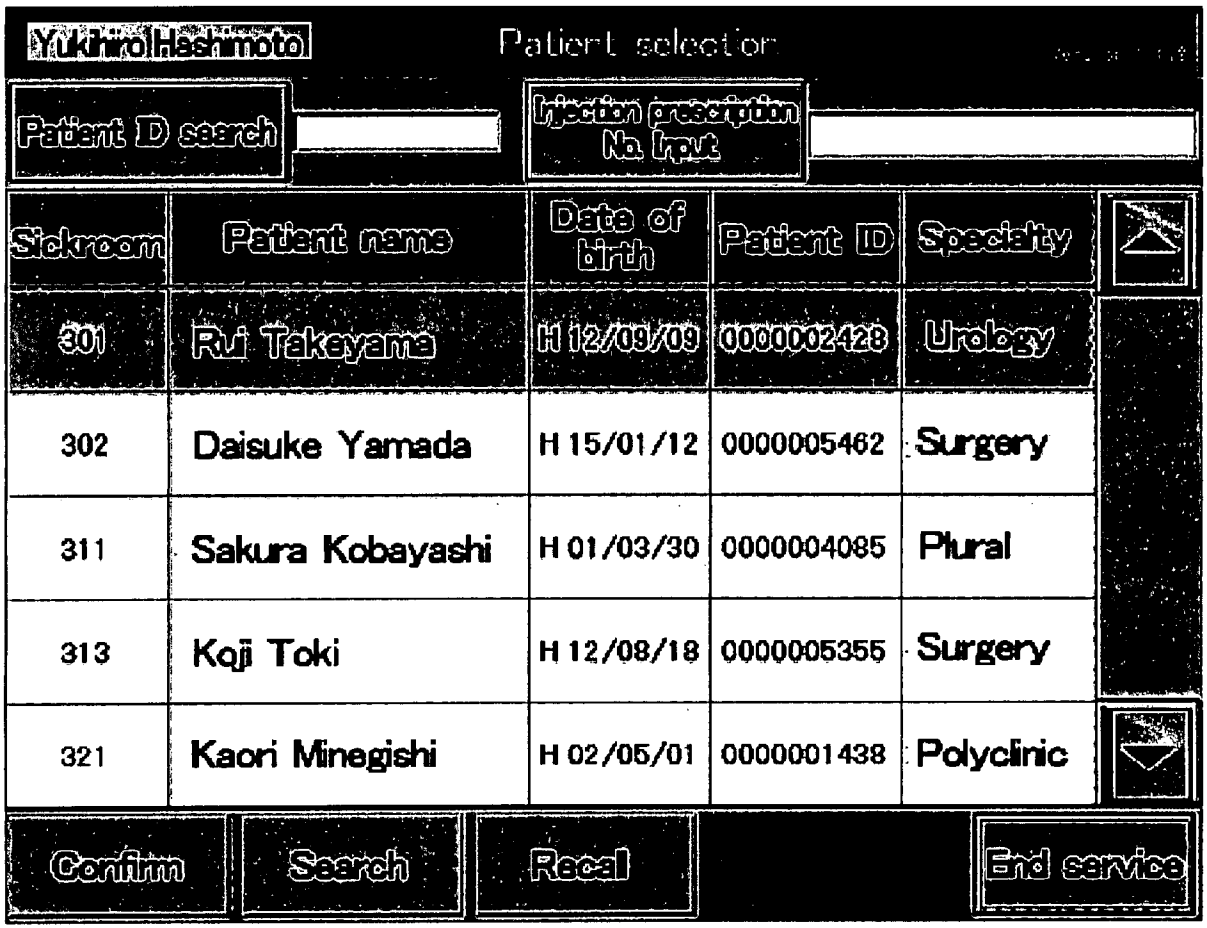
FIG. 29 is a view showing a patient selection screen displayed on the operation display screen.

In the free dispensation processing, as shown in the flow charts in FIG. 22 and FIG. 23, it is first determined whether or not authentication in the user authentication device 7 has appropriately been performed (step S1). Herein, a dispense button on the menu screen shown in FIG. 27 is touched and a fingerprint is pressed to a rectangular frame on the fingerprint authentication screen shown in FIG. 28 displayed on the center portion. Consequently, the pressed fingerprint is read and collated with the pre-registered data base. If the registered fingerprint data is present, then it is determined that the authentication was appropriately performed. Once the fingerprint was recognized as the registered fingerprint, the screen is switched to a patent selection screen shown in FIG. 29.

In the patient selection screen, it is determined whether or not selection of patient has been completed (step S2). In this case, the patient is selected from a list of patient data displayed on the screen, or the patient is specified by inputting the ID No. into the patient ID section and in this state, the confirm button is touched to select the patient. However, in the case where the patient name is unknown as in emergency cases and the like, it is possible to move to the next step without inputting the ID No. (in this case, the patient is handled as a dummy patient).

Based on the description content on the medicine name display portion provided on the rotor 23 in each of the cassettes 3, the driving switch 15 corresponding to the cassette 3 containing the medicine to dispense is operated, and if an ON signal is inputted (step S3), a dispensation request signal is outputted from the cassette controller 204 to the main controller 203 (step S4).

If a dispensation permission signal is inputted from the main controller 203 to the cassette controller 204 (step S5), the rotor 23 is rotated in forward direction to move the medicine D held in the holding recess portion 26 to the dispensing position (step S6). Moreover, the indicator 19 of the cassette 3 containing the medicine D to be moved to the dispensing position lights in blue color (step S7). This enables the authorized operator to take out the medicine D held in the holding recess portion 26 of the rotor 23 positioned at the dispensing position. Herein, it is desirable to output the name of the medicine by voice based on the voice data registered on the medicine master. This makes it possible to appropriately prevent mistakes of dispensed medicines. The voice output is particularly convenient for use in operation rooms and emergency cases.

Next, it is determined whether or not the end button has been operated on the dispensing operation screen displayed on the later-described operation display panel 6 (step S6).

Until the end button is operated, based on the ON signal inputted by the next operation of the driving switch 15 (step 9), the rotor 23 is rotated in a backward direction by the driving mechanism 51 so as to be stopped at the receiving position (step S10).

Then, it is determined whether or not delay time for the remaining number confirmation has passed based on whether or not a time long enough for the medicine D in the cassette 3 to move to the holding recess portion 26 of the rotor 23 stopped at the receiving position has passed (step S11). If the delay time for the remaining number confirmation has passed, then the remaining number of the medicines D in the cassette 3 is calculated (step S12). More specifically, by the position of the reed switch 14 which is turned on by approach of the magnet 32 of the pressing unit 24 among a plurality of the reed switches 14 provided at the positions corresponding to the medicines D aligned in the cassette 3, the current remaining number N of medicines aligned between the pressing unit 24 and the holding recess portion 26 of the rotor 23 is calculated.

Next, it is determined whether or not the remaining number N of medicines has changed or not (step S13). If the remaining number N of medicines has not changed, then it is determined that the rotor 23 has rotated from the dispensing position to the receiving position without dispensing the medicine D, and the procedure returns to the operation display panel 6 and the previous processing is repeated. If the remaining number of medicines has changed, then it means that one of the medicines D in the cassette 3 has been dispensed, and so "1" is added to the dispensed number N of the medicines D (step S14). Then, unless the medicines D in the cassette 3 are depleted (step S15), the procedure returns to the step S4 and the previous processing is repeated.

Then, after dispensation of the medicine D has been completed, if it is determined that the end button has been operated in the step S8, then the rotor 23 is rotated in backward direction and is stopped at the receiving position (step S16). Then, by the reed switch 14 and the magnet 32 of the pressing unit 24 which are the detection means, the remaining number of medicines D in the cassette 3 is calculated (step S17), and the free dispensation processing is ended.

It is to be noted that when the medicines D in the cassette 3 are depleted during dispensation of the medicines D, the processing is mandatorily stopped based on the determination in the step S15.

Moreover, although in the free dispensation processing, the rotor 23 was rotated from the receiving position to the dispensing position only in the cassette 3 whose driving switch 15 was operated, the rotors 23 of all the cassettes 3 may be rotated to the dispensing position at the start. More particularly, whether or not the medicine D is present in the holding recess portion 26 of the rotor 23 rotated to the dispensing position is detected by an unshown sensor, and only when it is determined that the medicine D is not present, the rotor 23 is rotated to the receiving position, and then is again rotated to the dispensing position while holding the next medicine D. With this arrangement, a desired medicine D can be dispensed without operation of the driving switch 15, thereby increasing workability.

(Prescribed Dispensation Processing)

Figure 20:
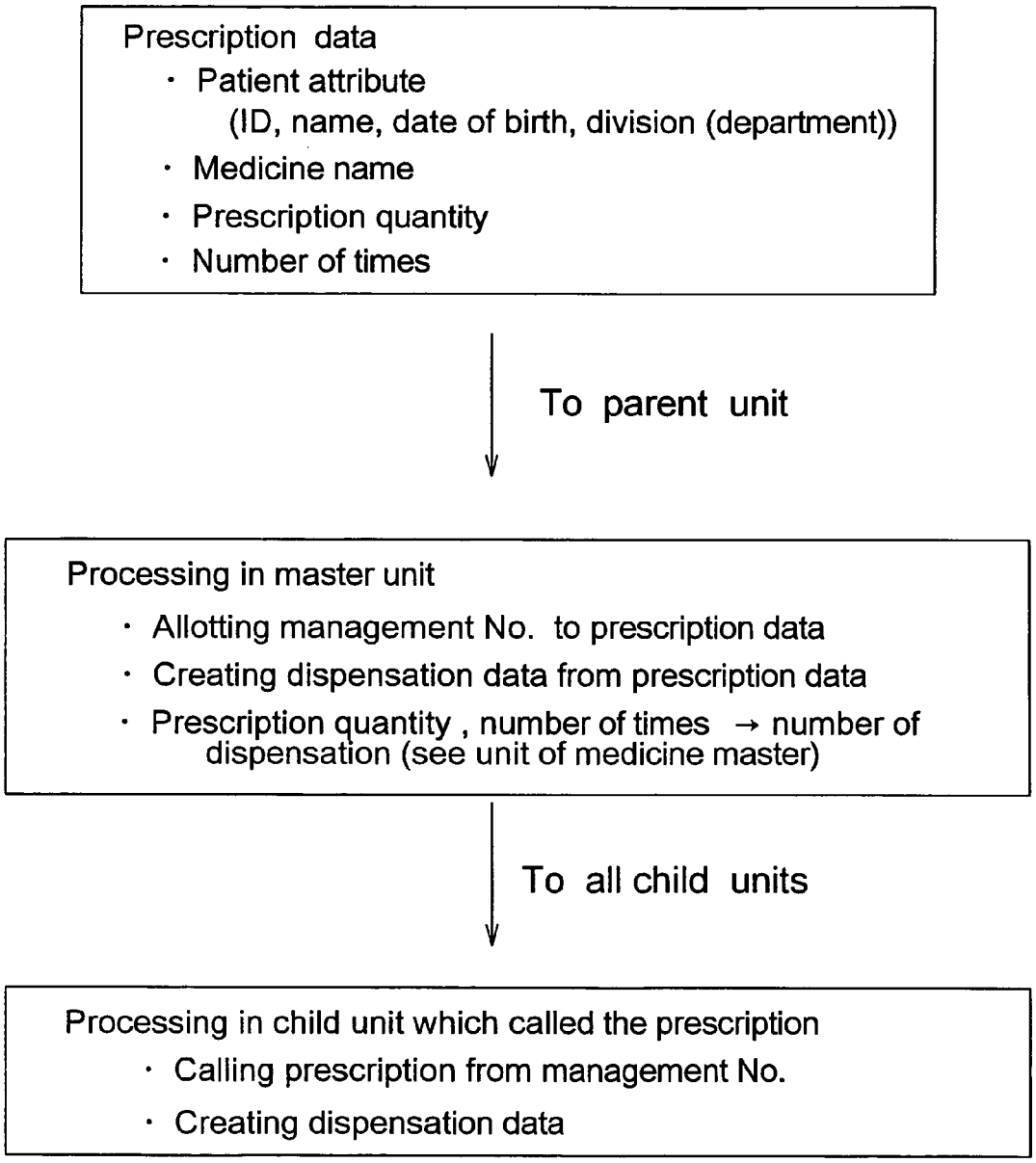
FIG. 20 is a view showing the flow of the entire prescribed dispensation processing.

The entire processing flow in the prescribed dispensation processing is shown in FIG. 20. First, the prescription data including the patient attribute, the medicine code, the prescription quantity and the number of times is inputted into the parent unit from the host computer. The parent unit allots a management No. to the inputted prescription data (hereinbelow referred to as an injection prescription No.) and creates dispensation data. All the child units make reference to the dispensation data created based on the prescription data (at this point of time, a buzzer sound is outputted to notify the operator of the transaction), and execute the pertinent medicine dispensation processing based on the management No.

Figure 24:
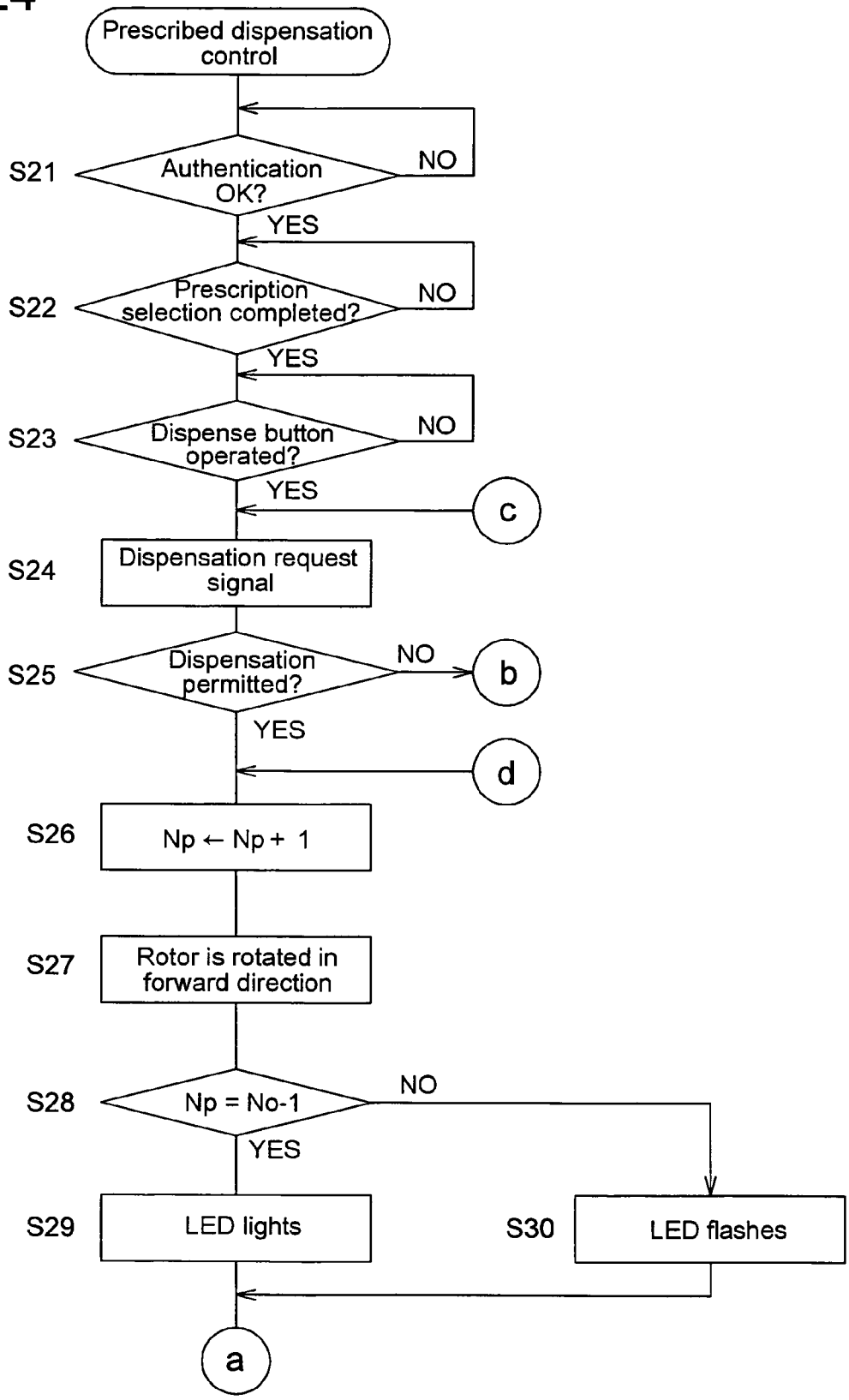
FIG. 24 is a flowchart showing prescribed dispensation processing.
Figure 25:
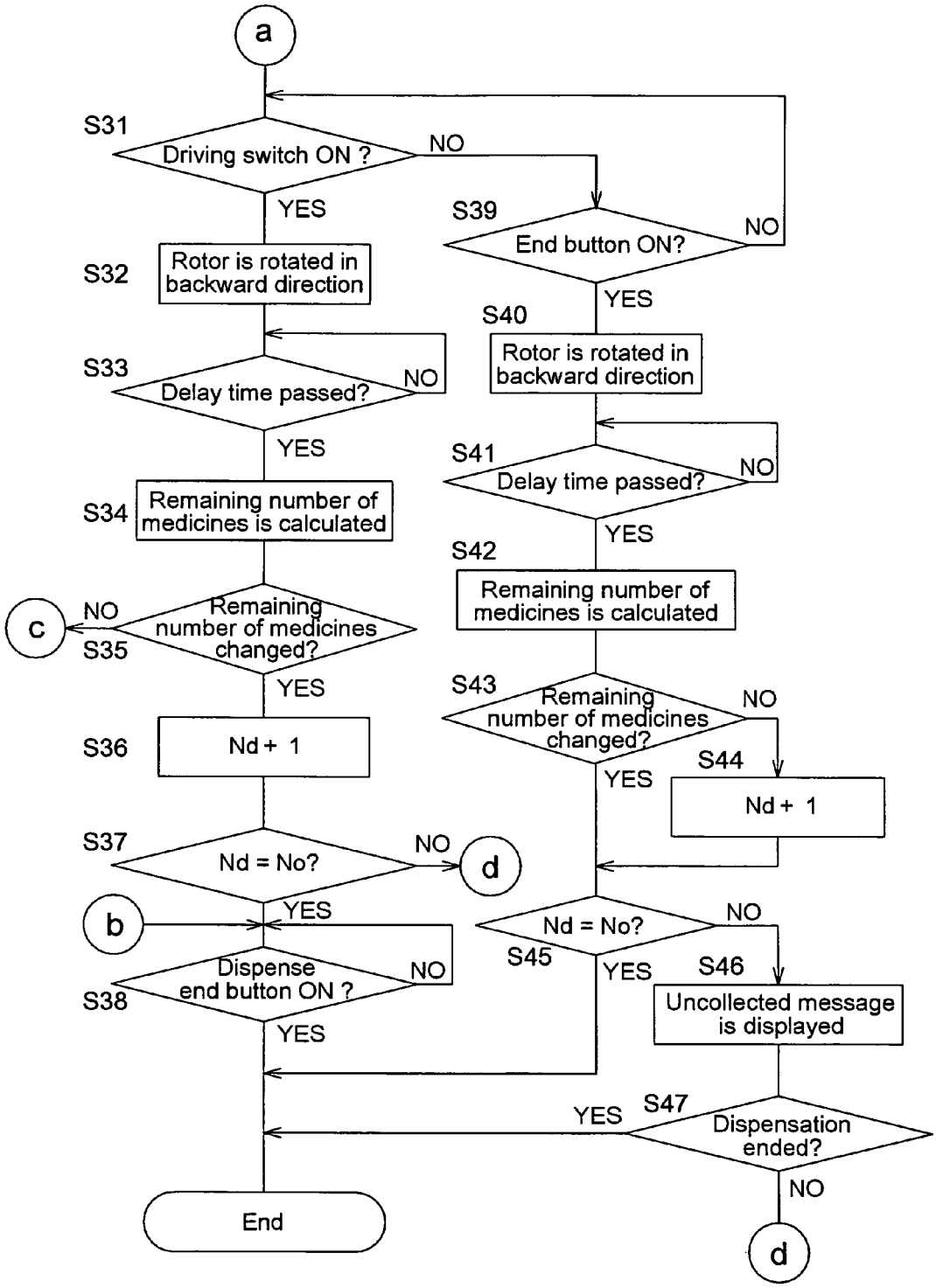
FIG. 25 is a flowchart showing prescribed dispensation processing.

Hereinbelow, detailed description is given with reference to FIG. 24 and FIG. 25. That is, as with the case of the free dispensation processing, after the fingerprint authentication has been performed on the operation display panel 6 (step S21), it is determined whether or not prescription selection has been completed (step S22). The prescription selection is performed by inputting the injection prescription No. on the patient selection screen shown in FIG. 29. However, if the bar code corresponding to the prescription data is printed on the injection prescription, then the prescription selection may be performed by reading the bar code by the bar code reader 102. When the dispense button displayed on the patient selection screen is touched (step S23), a dispensation request signal is outputted from the cassette controller 204 to the main controller 203 (step S24).

If a dispensation permission signal is inputted from the main controller 203 to the cassette controller 204 (step S25), "1" is added to the dispensation permitted number Np (step S26), and the rotor 23 is rotated in forward direction to move the medicine D held in the holding recess portion 26 to the dispensing position (step S27). Herein, it is determined whether or not the medicine D to dispense is the last medicine D based on whether or not the dispensation permitted number Np is smaller than the dispensation request number No by 1 (step S28). If the medicine D to dispense is not the last medicine D ($Np \neq Np-1$), then the indicator (LED) 9 flashes in blue color (step S29), and if the medicine D is the last medicine ($Np=Np-1$), then the indicator (LED) 9 lights in blue color (step S30). It is to be noted that the indicator flashes in orange color in the case of cassette errors (rotation failures of the rotor 23 and the like) and lights in orange color in the case of medicine stock-out or low level. If the dispensation permission signal is not inputted in the step S25, then the processing is ended upon operation of the end button in the step S38.

Herein, if the driving switch 15 corresponding to the rotor 23 which moved the medicine D to the dispensing position is operated (step S31), the rotor 23 is rotated in backward direction (step S32), and after the transaction is put in standby for a delay time for confirmation of the remaining number of medicines (step S33), the remaining number of medicines is calculated (step S34). Then, if the quantity of medicines remains unchanged (step S35), the procedure returns to the step S27 and the previous processing is repeated, whereas if the quantity of medicines has been changed, "1" is added to the number of dispensed medicines Nd (step S37). Until the number of dispensed medicines Nd reaches the dispensation request number No, the procedure returns to the step S24 and the previous processing is continued. If the number of dispensed medicines Nd has reached the dispensation request number No, the transaction is put in standby until the driving switch 15 is operated, and after the rotor 23 is moved to the receiving position upon operation of the driving switch 15, the end button (service end button shown in FIG. 29 or FIG. 32) is touched (step S38) to end the processing Even if the driving switch 15 is not operated in the step S31, the rotor 23 is rotated in backward direction (step S40) upon operation of the end button (step S39) as with the previous case, and after the transaction is put in standby for a delay time for confirmation of the remaining number of medicines (step S41), the remaining number of medicines is calculated (step S42). Then it is determined whether or not the quantity of medicines has been changed (step S43), and if it has been changed, "1" is added to the number of dispensed medicines Nd (step S44), whereas if it remains unchanged, then it is determined whether or not the number of dispensed medicines Nd has reached the dispensation request number No (step S45). If the number of dispensed medicines Nd has reached the dispensation request number No, the processing is ended while the rotor 23 is positioned at the receiving position, whereas if it has not reached the dispensation request number No, an collected message is displayed on the operation display panel 6 (step S46). Then, if the dispensation processing is not yet ended (step S47), the procedure returns to the step S28 and the previous processing is repeated.

Thus, if the taking out of the medicine is finished, the rotor 23 is rotated to the receiving position and the holding recess portion 26 of the rotor 23 is put in the state hidden in the cassette 3, which makes it impossible to rotate the rotor 23 from the outside and take out the medicine D without permission. Therefore, in the case of handling narcotic drugs or potentially dangerous drugs, appropriate management is achieved without paying particular attention.

(Medicine Specification/Dispensation Processing)

This processing is almost the same as the prescribed dispensation processing except in the point that instead of determining whether or not the prescription selection has been completed, it is determined whether or not patient selection has been completed and whether or not medicine selection has been completed. Since whether or not patient selection has been completed is determined in the same way as in the free dispensation processing, description is given of the determination whether or not medicine selection has been completed with reference to the display content on the operation display panel 6.

Figure 30:
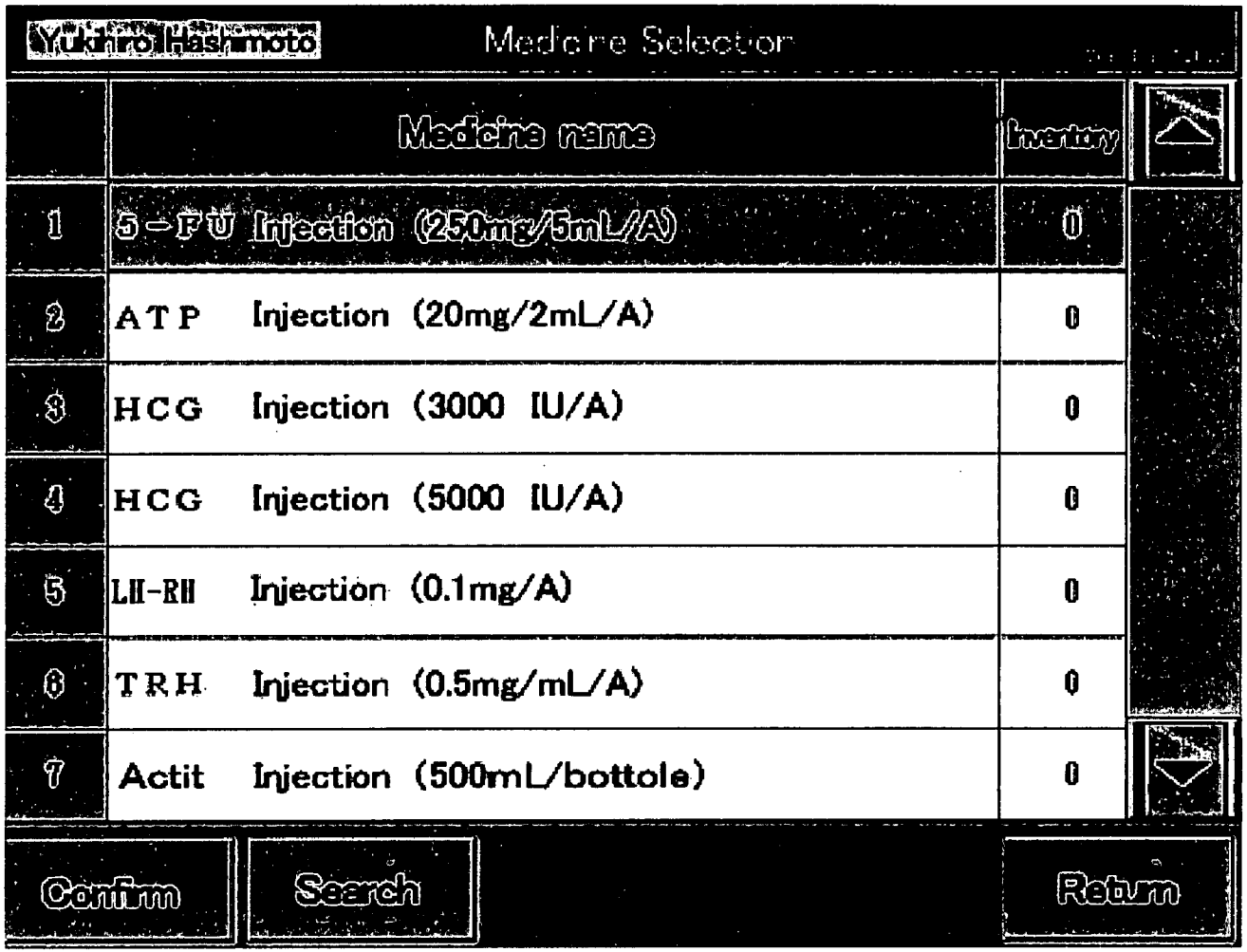
FIG. 30 is a view showing a medicine selection screen displayed on the operation display screen.
Figure 31:
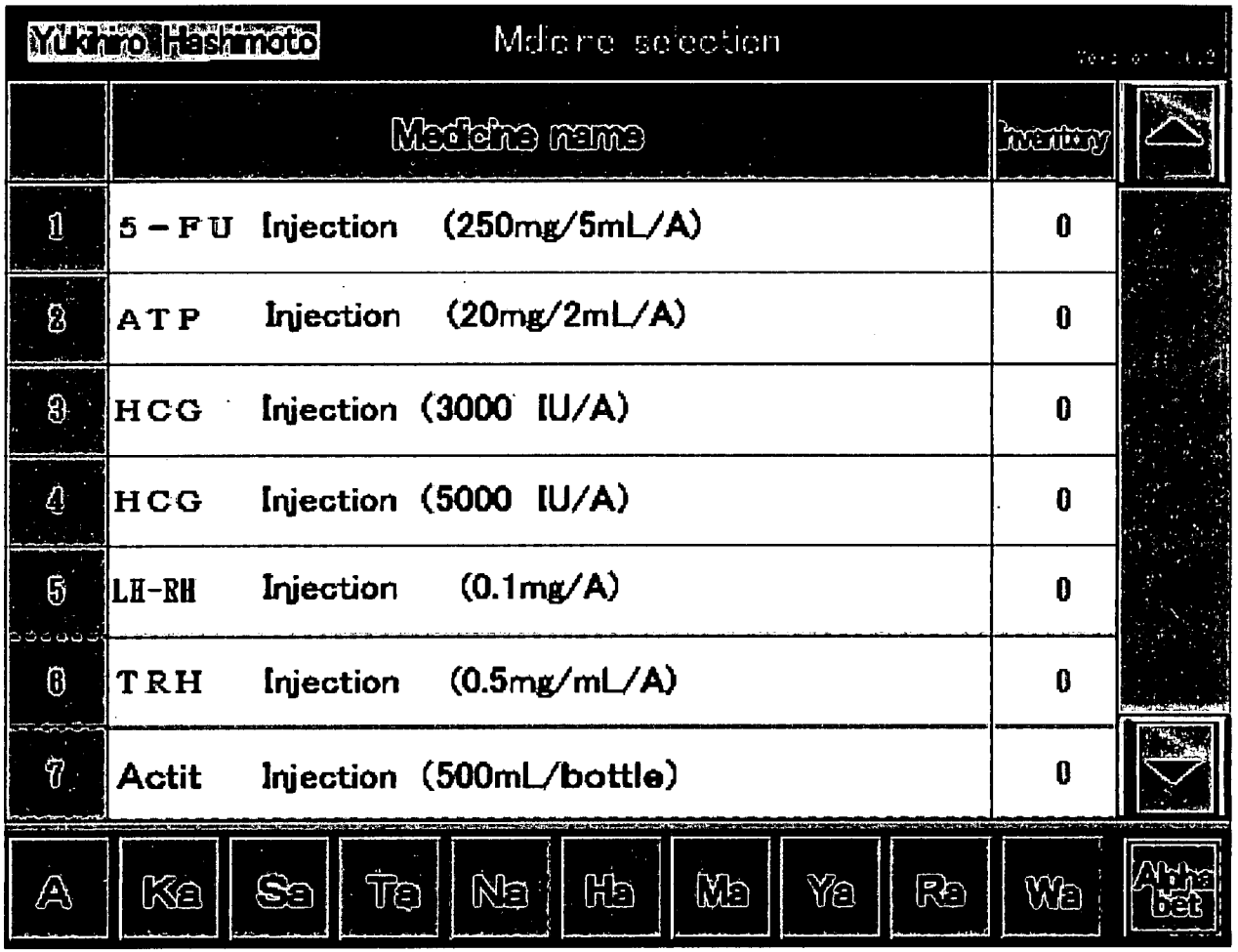
FIG. 31 is a view showing the medicine selection screen of FIG. 30 with a narrow-down search by character section popped up.

That is, when a patient is selected on the patient selection screen and the confirm button is touched, the screen is switched to a medicine selection screen shown in FIG. 30. On the medicine selection screen, the pertinent medicine may be selected from a displayed medicine list, or the search button is touched to display a narrow-down search by character section composed of the line of Japanese syllabary containing the 'a' sound or alphabets as shown in FIG. 31, and by selecting any one of the displayed characters, the medicines starting with the selected character are displayed as a list, from which the medicine may be selected. In search operation by the search button, the medicines can be narrowed down by sequentially selecting the displayed characters in the narrow-down search by character section.

Figure 32:
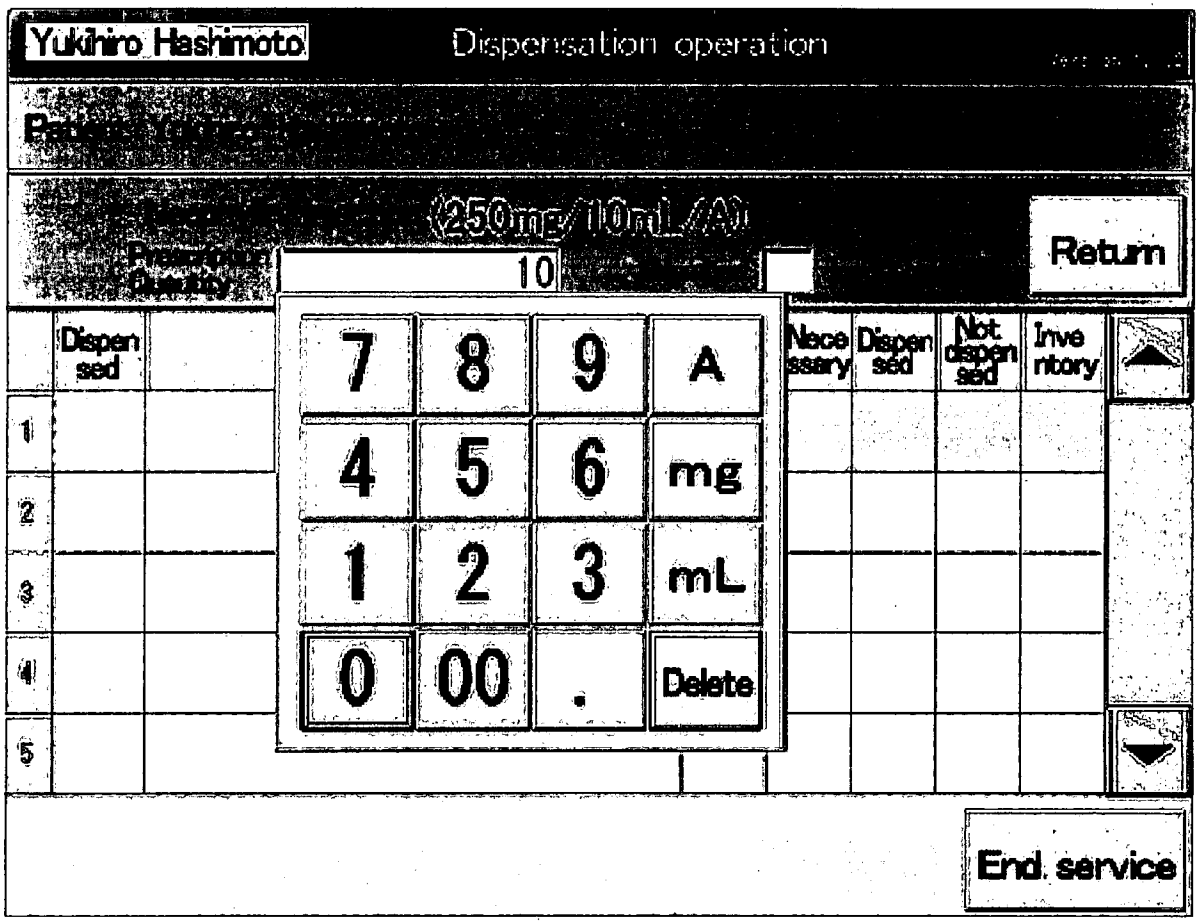
FIG. 32 is a view showing the medicine selection screen displayed on the operation display screen with a prescription quantity entry screen popped up.

Once the medicine is selected in this way, the confirm button is touched to pop up a prescription quantity input screen shown in FIG. 32, where numerical data and units are inputted, and then an screen (not shown) to input the number of prescription times is popped up to input the number of prescription times, by which the medicine selection processing is completed.

Figure 26:
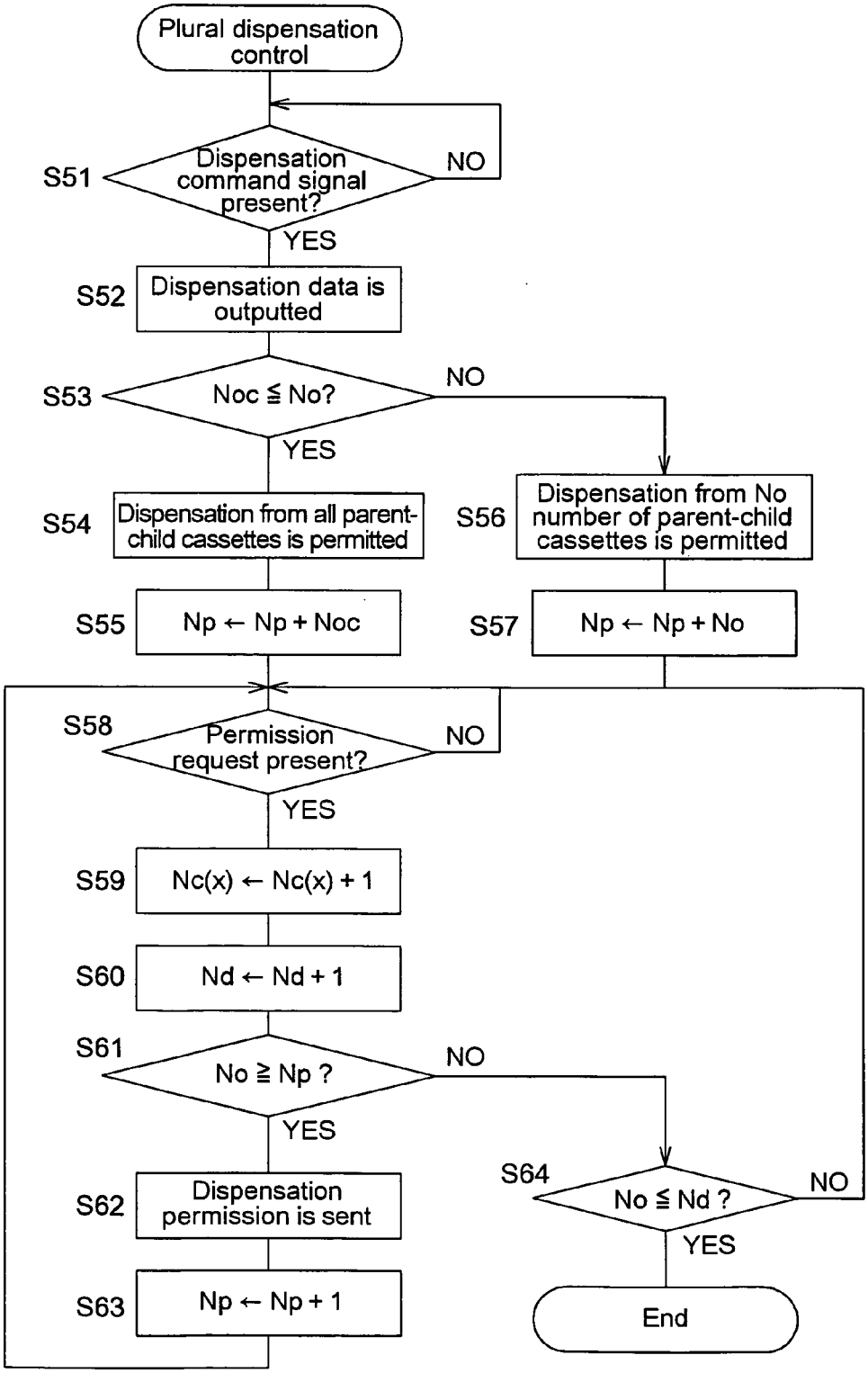
FIG. 26 is a flowchart showing dispensation processing.

While in the prescribed dispensation processing and the medicine specification/dispensation processing, upon touch operation of the dispense button, the medicine dispensation processing from the cassette 3 containing the pertinent medicine is started, in the case of containing the identical medicines in a plurality of cassettes 3, the dispensation processing is executed following the flowchart shown in FIG. 26.

First, it is determined whether or not dispensation data (dispensation order signal) to the parent-child cassettes has been received (step S51). If the dispensation data has been received, the dispensation data is outputted to the pertinent parent-child cassettes (step S52). FIG. 21 shows an example of creating dispensation data based on the prescription specifications for 2 medicines A, 1 medicine B and 4 medicines C. More particularly, based on the prescribed specifications, reference is made to the medicine location master and the cassette master to create dispensation data composed of a command segment, the dispensation number, the number of cassettes and the cassette Nos. In one command segment, the dispensation number, the number of cassettes and the cassette Nos. are stored in sequence, by which the data length can be decreased and dispensation of identical medicines from a plurality of the cassettes 3 can be executed easily.

Herein, it is determined whether or not the number of medicines in parent-child cassettes Noc is not more than the dispensation request number No (step S53). In the case where the number of medicines in parent-child cassettes Noc is not more than the dispensation request number No, even if the medicines D are dispensed from all the parent-child cassettes, a dispensable medicine quantity will not exceed the dispensation request number No. Therefore, dispensation from all the parent-child cassettes (101 to 103) is permitted (step S54), and the number of medicines in parent-child cassettes Noc (3 in this example) is added to the dispensation permitted number Np (step S55). In the case where the number of medicines in parent-child cassettes Noc exceeds the dispensation request number No, e.g., in the case where the number of medicines in parent-child cassettes Noc is 3 and the dispensation request number No is 2, if the medicines D are dispensed from all the parent-child cassettes, the dispensable medicine quantity exceeds the dispensation request number No. Therefore, the dispensation request is permitted only to the cassettes 3 containing the medicines of the dispensation request number No (step S56), and the dispensation request number No is added (step S57). This prevents unnecessary dispensation.

Then, if a permission request from the cassette 3 is present (step S58), "1" is added to the dispensed cassette number Nc (x) (step S59), and "1" is added to the dispensed number Nd (step S60).

Next, it is determined whether or not the dispensation request number No is not less than the dispensation permitted number Np (step S61). If the dispensation request number No is not less than the dispensation permitted number Np, a dispensation permission signal is sent to the pertinent cassette 3 (step S62), and "1" is added to the dispensation permitted number Np (step S63). If the dispensation request number No is less than the dispensation permitted number Np, then it is determined whether or not the dispensation request number No is not more than the dispensed number Nd (step S64). If the dispensation request number No is not more than the dispensed number Nd, the processing is ended, whereas if it is more than the dispensed number Nd, the procedure returns to the step S58 and the previous processing is repeated.

Thus, the dispensation permitted number Np and the dispensed number Nd are collated after the dispensation request number No and the dispensation permitted number Np are collated, and this is because in the state that the dispensation permission has been issued and the rotor 23 has been rotated to the taking out position, it is impossible to determine whether or not the medicine D has already been taken out from the holding recess portion 26. More particularly, in this structure, dispensation of the medicine D is not completed until the medicine D is taken out from the holding recess portion 26 and the driving switch 15 is pressed, the rotor 23 is rotated to the receiving position, the quantity of medicines contained in the cassette 3 is confirmed to be decreased, and the dispensation permission request from the cassette controller 204 is confirmed. By this, accurate dispensation by the parent-child cassettes becomes possible.

It is to be noted that since the quantity of medicines D contained in the cassette 3 is detected by the reed switch 14 that is the detection means, based on the detection signal, a specified display can be offered as well as low level warning can be issued.

Moreover, although the cassettes 3 have been disposed in horizontal direction so as to stack the medicines in vertical direction, the cassettes 3 may be disposed in vertical direction or at an angle. According to this arrangement, the shape of the stock shelf 2 may be appropriately changed in conformity to the placement space. For example, in the case where the placement space of the stock shelf 2 can be secured only on the lower side, the cassettes 3 may be disposed vertically so that the medicines D are taken out from the upper face side. Moreover, the cassettes 3 may be disposed sideways so that the cap sides of vials and the like face up.

Moreover, instead of contact-type sensors such as the driving switches 15, noncontact-type sensors such as area sensors for detecting approach of human hands may also be used. Moreover, it is also possible to provide sensors for detecting the presence of the medicine D in the holding recess portion 26 of the rotor 23 and to automatically rotate the rotor 23 to the receiving position when the absence of the medicine D in the holding recess portion 26 is determined in the state that the rotor 23 is rotated to the dispensing position.

Moreover, although driving control over the rotor 23 of each of the cassettes 3 has been exercised through the cassette controller 204 and the main controller 203, it is also possible to include and fulfill the function of the main controller 203 or the functions of both the controllers 203, 204 in the control device 100. What is important is the structure which allows dispensation of the medicines D through exchange of the dispensation request signal and the dispensation permission signal.

What is claimed is:

1. A medicine dispensing apparatus comprising a control means and a plurality of cassettes that contain medicine containers in alignment, each of the cassettes comprising:

pressing means for pressing the medicine containers in each of the cassettes toward a front end side of the cassette;

dispensing means disposed at the front end portion of each of the cassettes, the dispensing means having a holding recess portion for holding a medicine container;

driving means for rotating the dispensing means to a receiving position at which one of the medicine containers in the cassette can be received in the holding recess portion and to a taking out position at which the medicine container held in the holding recess portion can be directly taken out by an operator;

display means for displaying whether the cassette contains medicine required to be dispensed from among the plurality of cassettes, the display means being provided on the front end portion of the corresponding cassette; and a driving switch for actuating the driving means to cause rotation of the dispensing means, the driving switch being provided on the corresponding cassette, wherein the control means is operable to control operation of the driving means of the cassettes so as to rotate the dispensing means from the receiving position to the taking out position when the driving switch of the cassette indicated by the display means is turned on and then, when the driving switch is further turned on, rotate the dispensing means from the taking out position to the receiving position and then rotate the dispensing means from the receiving position to the taking out position by the driving means, wherein the medicine dispensing apparatus further comprises an end button which is pressed when a necessary number of mediations are taken out, wherein, when the end button is operated, the control means turns off the display by the display means and controls the driving means to rotate the dispensing means from the taking out position to the receiving position.

2. The medicine dispensing apparatus as claimed in claim 1, further comprising:

storage means for storing a quantity of inventory of medicines in the cassette;

detection means for detecting a current quantity of medicines in the cassette; and notification means for notifying that the medicine is left uncollected, wherein the control means controls the notification means to provide notification that the medicine is left uncollected when the current quantity of the medicines detected by the detection means is equal to the quantity of inventory stored in the storage means.

3. The medicine dispensing apparatus as claimed in claim 1, wherein when the current quantity of the medicines detected by the detection means is smaller than the quantity of inventory stored in the storage means, the control means stores the current quantity of the medicines detected by the detection means in the storage means as a quantity of inventory.

4. The medicine dispensing apparatus as claimed in claim 1, further comprising authentication means for authenticating an operator of the medicine dispensing apparatus, wherein the control means executes the control operation only when the operator is authenticated by the authentication means as an authorized operator.

5. The medicine dispensing apparatus as claimed in claim 2, further comprising authentication means for authenticating an operator of the medicine dispensing apparatus, wherein the control means executes the control operation only when the operator is authenticated by the authentication means as an authorized operator.

6. The medicine dispensing apparatus as claimed in claim 3, further comprising authentication means for authenticating an operator of the medicine dispensing apparatus, wherein the control means executes the control operation only when the operator is authenticated by the authentication means as an authorized operator.

7. The medicine dispensing apparatus as claimed in claim 1, wherein each of the display means comprises at least two LED's disposed the front end side of the respective cassette.

8. The medicine dispensing apparatus as claimed in claim 1, wherein the dispensing means comprises a rotor formed with the holding recess portion.

9. The medicine dispensing apparatus as claimed in claim 8, wherein the rotor has notches formed on opposite sides of the holding recess portion to permit the medicine container to be removed therefrom by the operator.

* * * * *